US005774759A

United States Patent [19]

Tanaka

[11] Patent Number: 5,774,759

[45] Date of Patent: Jun. 30, 1998

[54] CONTROL SYSTEM FOR A DIGITAL COPYING MACHINE, A FACSIMILE MACHINE AND OTHER PROCESSING APPARATUS

[75] Inventor: Tomoki Tanaka, Yamatokoriyama, Japan

[73] Assignee: Sharp Kabushiki Kaisha, Osaka, Japan

[21] Appl. No.: 570,619

[22] Filed: Dec. 11, 1995

[30] Foreign Application Priority Data

Dec. 12, 1994 [JP] Japan ..... 6-307726

[51] Int. Cl.[6] ..... G03G 15/00

[52] U.S. Cl. ..... 399/8; 399/81; 364/146

[58] Field of Search ..... 355/200, 202, 355/204, 209; 395/114, 115; 364/146, 188, 192; 358/296; 399/8, 81

[56] References Cited

U.S. PATENT DOCUMENTS 4,970,550 11/1990 Hirayama ..... 355/200
5,537,605 7/1996 Teece ..... 364/146 X

FOREIGN PATENT DOCUMENTS 5-19551 1/1993 Japan .
5-37681 2/1993 Japan .

*Primary Examiner*—Joan H. Pendegrass

*Attorney, Agent, or Firm*—David G. Conlin; William J. Daley, Jr.

[57] ABSTRACT

Featured is a control system including a processing apparatus, such as a digital copying or facsimile machine and a terminal apparatus. The processing apparatus creates a control command on the basis of a control program previously stored in the processing apparatus and executes processing in accordance with the control command. The control program stored in the apparatus is transmitted to the terminal apparatus by means of an electromagnetic transmitter/receiver, such as an IRPCM transmitting part of an IR emit receiver part. The terminal apparatus executes the control program therein, creates a control command for the processing apparatus and transmits the control command to the processing apparatus via the transmitter/receiver. Additionally, the processing apparatus transmits internal information within the processing apparatus to the terminal apparatus through the transmitter/receiver, where the internal information indicates the state of the processing apparatus at the time of responding to the control command. If the control program is a plurality of hierarchal layers, then it is transmitted to the terminal apparatus layer by layer. If the control program is dependent upon the type of terminal apparatus being used, then the terminal apparatus communicates the required information to the processing apparatus, which retrieves the appropriate control program from memory, and transmits same to the terminal apparatus.

5 Claims, 28 Drawing Sheets

CONTROL SYSTEM FOR A DIGITAL COPYING MACHINE, A FACSIMILE MACHINE AND OTHER PROCESSING APPARATUS

BACKGROUND OF THE INVENTION

1. Field of the Invention

The invention relates to a control system which controls various types of processing apparatuses such as a digital copying machine which conducts print processing of image data and more particularly, to an apparatus which controls such a processing apparatus by remote control.

2. Description of the Related Art

In general, a processing apparatus such as a digital copying machine comprises an operation panel for controlling the processing apparatus. To control the processing apparatus, control data are inputted on the operation panel so that processing which corresponds to the control data is executed. However, in the processing apparatus of a conventional structure, the control data for the processing apparatus can be inputted only through the processing apparatus itself. Therefore, when the operation panel is behind an obstacle, inputting of the control data may be difficult. To be specific, for example, when an original document table and the operation panel are disposed on a top face of a digital copying machine, if the size of an original document to be copied is large, the original document extends beyond the original document table and covers the operation panel, whereby an operation of the operation panel becomes difficult.

To deal with this problem, Japanese Unexamined Patent Publication JPA 5-19551 (1993) discloses that the operation panel of the processing apparatus is constructed detachable from the processing apparatus and an operation panel is used as a remote controller to operate the processing apparatus by radio using an infrared light beam or the like.

As described above, a processing apparatus such as a digital copying machine is remotely operated using a remote controller, so that it is possible to control the processing apparatus by the remote controller even though there is an obstacle to an operation of the operation panel on the processing apparatus. However, an apparatus which is controlled by conventional remote control has the following problems.

Even when there is any change in the condition of the processing apparatus such as a jam error, the error can not be recognized on the remote controller side, which may cause a trouble in remote controlling. That is, a conventional remote controller only sends control signals to the processing apparatus. In other words, the processing apparatus does not send a specific signal to be received by the remote controller, corresponding to a change in the condition of the processing apparatus.

A conventional remote controller, as described in Japanese Unexamined Patent Publication JPA 5-19551 (1993), is dedicated to a particular processing apparatus, and hence a control program specific to the particular processing apparatus is stored previously. Therefore, in the case of controlling a plurality of processing apparatuses, it is necessary to provide a remote controller dedicated to each processing apparatus.

In order to solve this problem, such a method is proposed that control programs for the processing apparatus is supplied to a portable terminal apparatus comprising a CPU, a memory, radio communication means (an infrared ray emitting/receiving part) and the like using a IC card, etc. However, there are different control methods and different command systems for different types of processing apparatuses. Therefore, to prepare for a case where a plurality of (plural types of) processing apparatuses are to be controlled by one portable terminal apparatus, the IC card must store control programs for all types of processing apparatuses. This wastefully uses the memory capacity, causes shortage of a memory, or leads to other problems. Further, every time a new type of processing apparatus is created, it is necessary to update the IC card to deal with the new processing apparatus or to buy an IC card which is newly programmed.

SUMMARY OF THE INVENTION

It is hence an object of the invention to provide for an inexpensive control system for a processing apparatus enabling to eliminate wastefulness which is attributed to supplying a specific program to each individual terminal apparatus, such as a wasteful use of memory on the side of the terminal apparatus as a remote controller and a wasteful purchase of an IC card which stores a new program to deal with a processing apparatus of a new type.

The invention provides a control system for a processing apparatus comprising a processing apparatus which creates a control command on the basis of a control program previously stored in the processing apparatus and which executes processing such as copying in accordance with the control command, a terminal apparatus which creates a control command on the basis of the control program stored in the apparatus, communication means for connecting the processing apparatus to the terminal apparatus using infrared rays or the like so that data is transmitted and received, transmission means for transmitting the control program previously stored in the processing apparatus to the terminal apparatus through the communication means, and transmission means for transmitting the control command created on the basis of the control program to the processing apparatus.

Further, the invention is characterized in that the control system for a processing apparatus comprises transmission means for transmitting internal information such as an option mount condition and an error condition within the processing apparatus to the terminal apparatus through the communication means, and means for setting default and displaying a message regarding the terminal apparatus on the basis of the internal information transmitted to the terminal apparatus from the processing apparatus.

Still further, the invention is characterized in that the control system for a processing apparatus comprises detection means for detecting a change in the internal information such as an option mount condition and an error condition within the processing apparatus, and transmission means for transmitting post-change internal information to the terminal apparatus every time there is a change in internal information.

Yet further, the invention is characterized in that the control program is composed of a plurality of hierarchical layers and that transmission means for transmitting the control program layer by layer to the terminal apparatus is provided.

Further, the invention is characterized in that the processing apparatus comprises storage means for previously storing a control program type depending on a type of the terminal apparatus, transmission means for transmitting the type of the terminal apparatus connected to the processing apparatus through the communication means, to the processing apparatus, and means for selecting a control program type corresponding to the type of the terminal apparatus transmitted from the terminal apparatus and transmitting the control program of the type to the terminal apparatus.

According to the invention, control programs which are needed to control the processing apparatus are transmitted from the processing apparatus to the terminal apparatus. Hence, the terminal apparatus does not have to previously store control programs which are needed to control the processing apparatus. Rather, it is possible that the terminal apparatus receives a necessary control program directly from the processing apparatus and controls the processing apparatus (i.e., create a control command). Upon transmission of a control command to the processing apparatus such as a copying machine through the communication means, the processing apparatus operates on the basis of the control command, whereby the processing apparatus is controlled by the terminal apparatus.

In addition, according to the invention, internal information which are unique to the processing apparatus are transmitted to the terminal apparatus through the communication means, and default of the terminal apparatus is set or a message is displayed in the terminal apparatus in accordance with the internal information. For instance, an automatic document feeder apparatus, a sorter and the like are optionally mountable to a copying machine (the processing apparatus), and therefore the internal information is unique to each copying machine. However, this information is important in controlling the copying machine. For example, even if a control program for an automatic document feeder apparatus is included in the control programs, automatic feeding of original documents can not be executed unless the automatic document feeder apparatus is mounted to the copying machine. In the invention, such information is transmitted to the terminal apparatus, and default is set and a message is displayed in accordance with this information. This allows to suitably control each copying machine (the processing apparatus). Meanwhile, an operation condition of the processing apparatus such as an error condition is important for controlling. For example, when there is an error, proper maintenance or the like must be performed in order to cope with the error. In such a case as well, information indicative of the error is transmitted to the terminal apparatus and displayed as default setting or a message.

Further, according to the invention, post-change internal information is transmitted to the terminal apparatus when there is a change in the internal information within the processing apparatus. Hence, the terminal apparatus always has latest internal information. When there is a jam error in a copying machine (the processing apparatus), for instance, information indicative of this is immediately transmitted to the terminal apparatus, so that the terminal apparatus operates to deal with the jam. In addition, when the jam in the processing apparatus is eliminated, information indicative of this is transmitted to the terminal apparatus so that the terminal apparatus operates to deal with the elimination of the jam.

Still further, according to the invention, the control program for controlling the processing apparatus (i.e., for creating a control command) is composed of a plurality of hierarchical layers, and the hierarchical layers of the control program are transmitted to the terminal apparatus. Hence, the terminal apparatus receives a control program on a necessary hierarchical level. For instance, it is assumed that when copying process of a copying machine is controlled by a terminal apparatus, selection of paper size and selection of magnification in the same hierarchical layer are separately defined by individual control programs. It is also assumed that selection of paper size is necessary but selection of magnification is not necessary for copying to be executed. In such a case, only a control program for selection of paper size is transmitted to the terminal apparatus, and a control program for selection of magnification is not transmitted to the terminal apparatus. Since the control program is composed of a plurality of hierarchical layers and is transmittable in hierarchical layers to the terminal apparatus, it is possible to transmit only a necessary control program to the terminal apparatus.

Still further, according to the invention, the configuration of the control program transmitted from the processing apparatus is changeable depending on the type of the terminal apparatus. When the control program is transmitted to the terminal apparatus from the processing apparatus to control the processing apparatus by the terminal apparatus, if the capability of the processing apparatus is extremely high, the terminal apparatus may not be able to handle processing in some cases depending on the type of the terminal apparatus. However, as described herein, since the configuration of the control program transmitted to the terminal apparatus is changed depending on the type of the terminal apparatus, the terminal apparatus is provided with a control program which the terminal apparatus can handle. Thus, the problem mentioned above is avoided.

According to the invention, it is not necessary for the terminal apparatus to previously store a control program which is needed to control the processing apparatus. Rather, the terminal apparatus receives a necessary control program from the processing apparatus and controls the processing apparatus. Hence, even when it may be necessary to control a plurality of types of processing apparatuses using one terminal apparatus, it is not necessary to previously store a control program in the terminal apparatus. Rather, the terminal apparatus receives only a necessary control program from a processing apparatus and controls the processing apparatus, and therefore, a memory for storing an unnecessary control program is not needed. That is, this prevents wasteful use of a memory such as storing an unnecessary control program. In addition, even when a new type of processing apparatus is created, it is not necessary to replace the terminal apparatus or to purchase new parts (e.g., an IC card), since the terminal apparatus receives a control program directly from the new processing apparatus and controls the new processing apparatus. This prevents increase in cost.

Further, according to the invention, information unique to each processing apparatus, including the option mount condition to the processing apparatus and the error condition within the processing apparatus, is transmitted to the terminal apparatus, and the terminal apparatus executes setting of default or displaying of a message on the basis of the information. Hence, controlling performed by the terminal apparatus is suitable to a condition of the processing apparatus (i.e., internal information) which is to be actually controlled.

Still further, according to the invention, whenever an option mount condition or an error condition of the processing apparatus changes, post-change information is transmitted to the terminal apparatus. Hence, the terminal apparatus operates depending on the current condition of the processing apparatus.

Still further, according to the invention, the control program for controlling the processing apparatus are composed of a plurality of hierarchical layers and the control program is transmitted to the terminal apparatus layer by layer. Hence, the terminal apparatus receives a necessary hierarchical layer of the control program and controls the copying machine. This reduces a transmission time for transmitting a control program to the terminal apparatus and the capacity of the memory which is disposed within the terminal apparatus to store the control program.

Further, according to the invention, a problem that the processing apparatus cannot be controlled depending on the type of the terminal apparatus is not created. It is possible to control the processing apparatus using any type of terminal apparatus.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
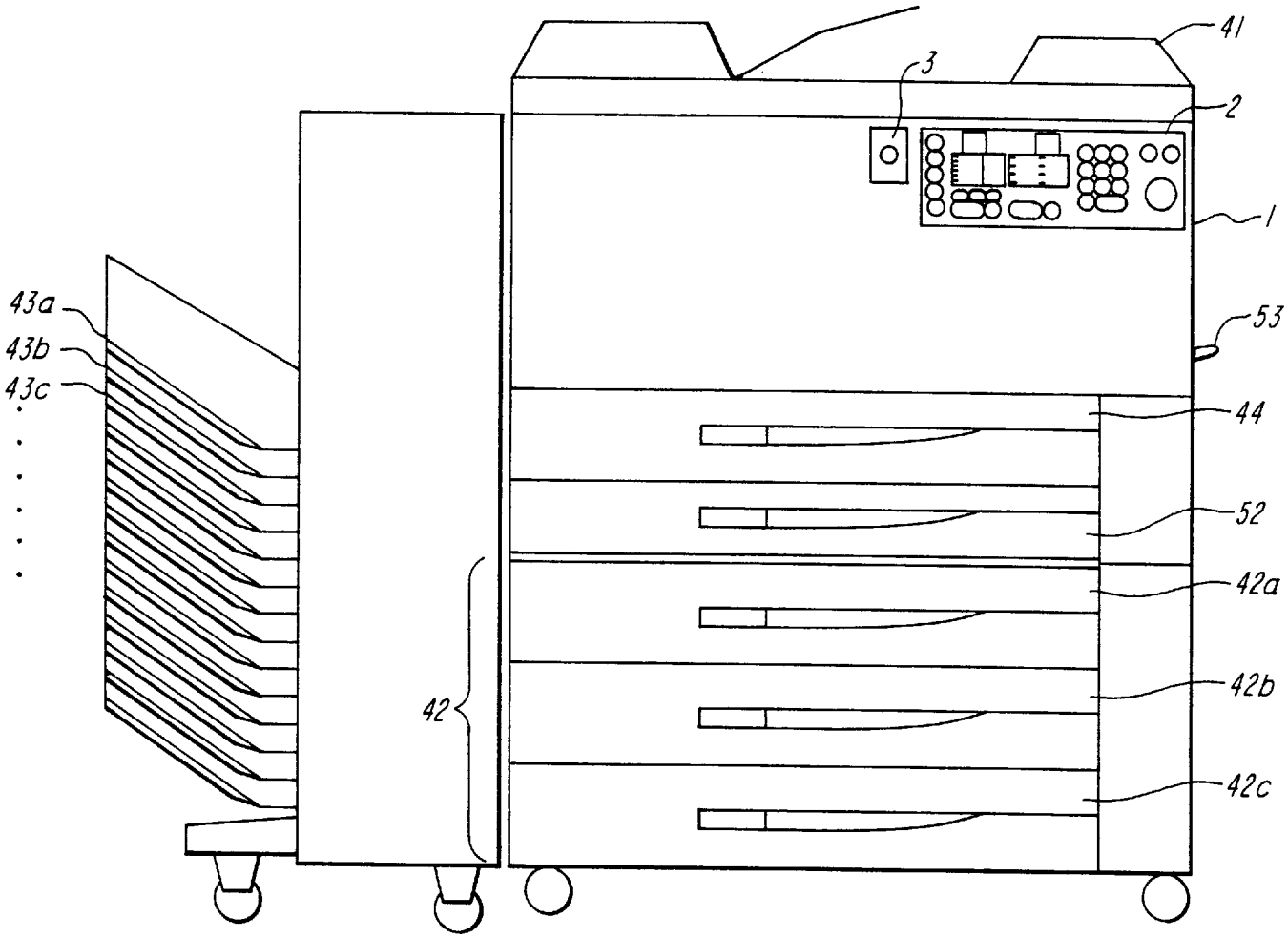
FIG. 1 is a front view showing an appearance of a digital copying machine which is an embodiment of a processing apparatus of the invention.

Now referring to the drawings, preferred embodiments of the invention are described below.

In the following, an embodiment of the invention will be described with reference to the drawings. Although the embodiment will take a digital copying machine as an example of a processing apparatus, the processing apparatus may be, for instance, a facsimile machine. That is, the invention is applicable to any apparatus which creates a control command based on a control program previously stored in the apparatus to thereby execute processing corresponding to the control command and which comprises radio communication means such as an IR interface. The invention is particularly useful for equipment in which a relatively complex item needs be set and an error needs be informed immediately. Further, a portable terminal apparatus may be any apparatus which comprises a CPU, a memory, radio communication means, etc.

(1) Structure of Copying Machine

Figure 2:
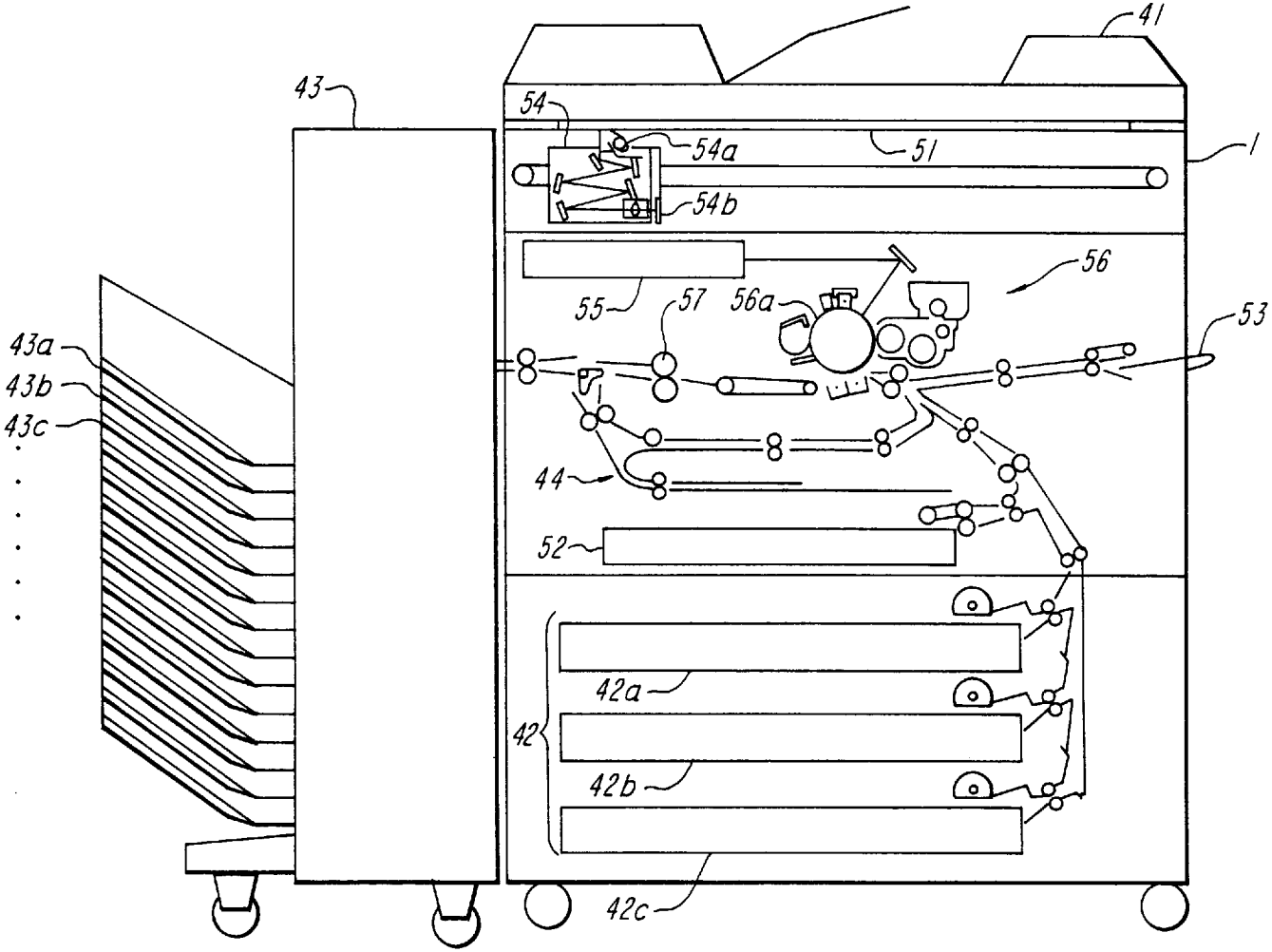
FIG. 2 is a view showing a schematic inner structure of the copying machine.

First, a description will be given on an essential structure of a digital copying machine, i.e., an example of a processing apparatus. FIG. 1 is a front view showing an appearance of the digital copying machine, and FIG. 2 is a schematic front sectional view of the digital copying machine. The copying machine 1 comprises optional apparatuses such as an automatic document feeder 41, a multi-story paper feeding cassette 42, a sorter 43 and a paper reversing mechanism 44. The optional apparatuses 41 to 44 comprise connectors for receiving a control signal from the copying machine 1, sensors and the like. As internal information regarding the copying machine 1, the copying machine 1 recognizes whether the optional apparatuses 41 to 44 are mounted to the copying machine 1 in accordance with conditions of the connectors, the sensors and the like.

The automatic document feeder 41 is an apparatus for feeding sheet-shaped original documents which are mounted on an original document table 41*a* one by one in an order to an original document table 51 and for discharging a scanned original document scanned on the original document table 51 to a paper discharge part 41*b*. The automatic document feeder 41 may comprise a paper reversing mechanism which reverses the top face of an original document. The multistory paper feeding cassette 42 can be additionally mounted in addition to a paper feeding cassette 52 and a manual paper feeding tray 53 which are mounted to the copying machine 1 in advance, and stores papers on which a copy image is to be formed. During copying, papers are fed selectively from either one of the cassettes 52, 53 or 42*a*, 42*b*, 42*c*. The cassettes 52, and 42*a* to 42*c* and the manual paper feeding tray 53 include sensors for detecting a paper size and sensors for detecting the existence of a paper. The copying machine 1 detects conditions of these sensors as the internal information. The sorter 43 is an apparatus which includes a mechanism for sorting copied papers into a plurality of paper discharge trays 43*a*, 43*b*, . . . and discharging the copies papers. The sorter 43 may further have a stapling function, etc. The paper reversing mechanism 44 temporarily stocks a copied paper for duplex copying or synthesizing copying, and reverses the top face of a copied paper.

Since a structure of an image formation part within the copying machine is similar to that of a regular digital copying machine, only a general description will be given here. A scanner 54 is disposed to a lower surface portion of the original document table 51 so as to be movable along the original document table 51. The scanner 54 includes a ramp reflector assembly 54*a* and a CCD 54*b*. The scanner 54 scans an original document which is mounted on the original document table 51 or an original document which is fed by the automatic document feeder 41, and reads image data of the original document. After various processes such as adjustments of density and magnification are executed, read image data are outputted to a semiconductor laser device 55 which will then convert the image data into laser light and output the laser light. An image formation processing part 56 includes a photosensitive element 56*a* and forms an image by a known electro-photographic method. On the photosensitive element 56*a*, laser light emitted from the semiconductor laser device 55 is focused into a toner image, and the toner image is transferred onto a paper which is fed from the manual paper feeding tray 53 or the cassettes 52, 42*a* to 42*c*. A fixing apparatus 57 performs fixing on a paper onto which the toner image is transferred, and the paper is then conveyed toward the sorter 43 or the paper reversing mechanism 44. When conveyed toward the sorter 43, the paper is discharged into either one of the paper discharge trays 43*a*, 43*b*, . . . which are externally mounted to the copying machine 1. When the paper is conveyed toward the paper reversing mechanism 44, an image is formed on the same face or the other face of the paper again.

Figure 3:
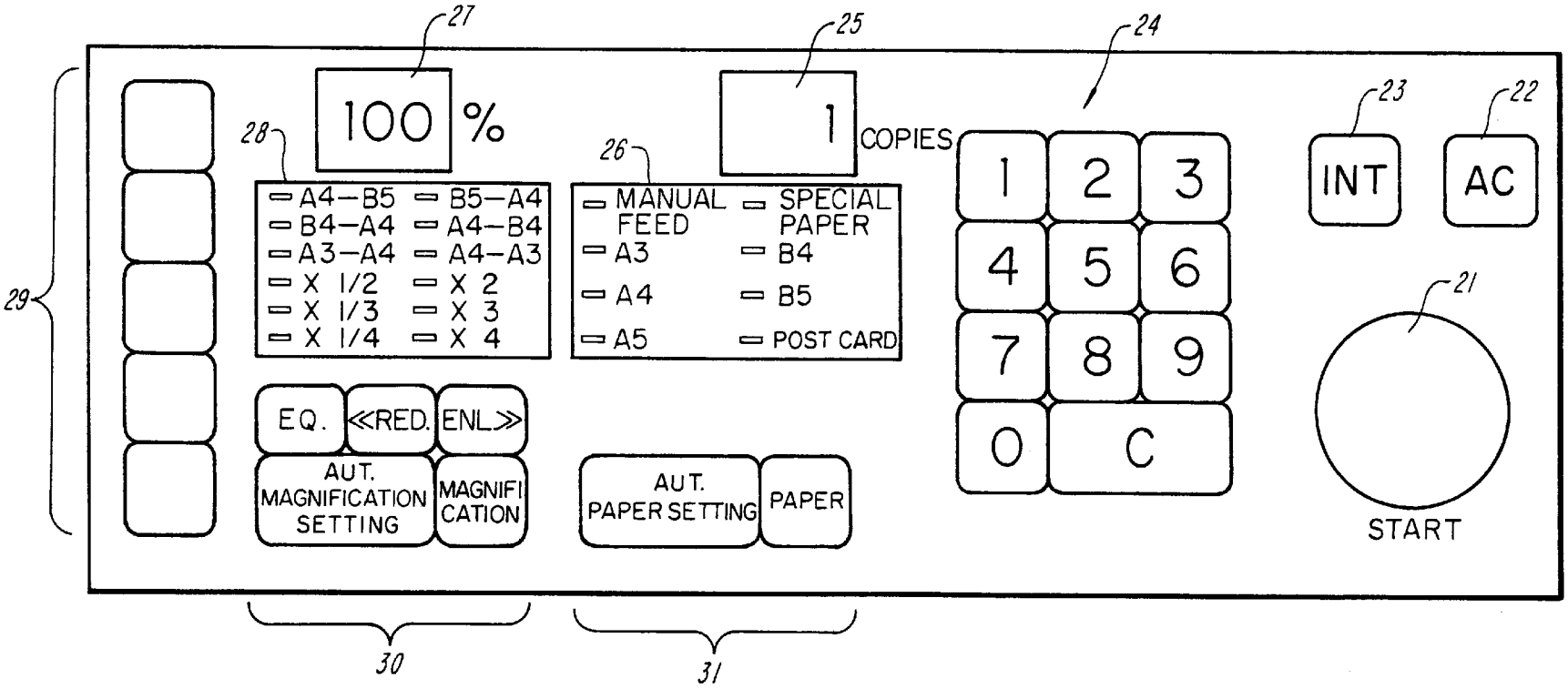
FIG. 3 is a view showing a structure of an operation panel of the copying machine.

An operation panel 2 and an IR emit/receive part 3 are disposed on the front face of the copying machine 1. FIG. 3 is a plan view showing a structure of the operation panel 2. On the operation panel 2, a display part is disposed which displays a plurality of key switches for controlling an operation of the copying machine as well as the current condition. More precisely, disposed on the operation panel 2 are: a copy job start button 21, an all clear button 22, an interrupting print button 23, numerical keys 24 for entering numerical values, a copy number display part 25, a paper size display part 26, an enlargement/reduction ratio display part 27, a preset enlargement/reduction ratio display part 28, a group of buttons 29 for setting various special modes, a group of buttons 30 for setting a magnification, and a group of buttons 31 for setting a paper.

Copying is started when the copy job start button 21 is pushed. When the all clear button 22 is pushed, all set values which are set on the operation panel are canceled and set again at default values which were set when the apparatuses were shipped from a factory or when at power is turned on. The interrupting print button 23 is used to suspend a current copy job during continuous copying on a number of papers and to execute interrupted copying. The copy number display part 25 is a part for displaying the number of copies which is inputted on the numerical keys or the like. The paper size display part 26 is a part for displaying a selected one of the manual paper feeding tray 53 or the cassettes 52, 42*a* to 42*c* and to display the size of papers which are contained in the selected tray or cassette. The enlargement/reduction ratio display part 27 is a part for displaying a copy magnification which is set. The preset enlargement/reduction ratio display part 28 is a part for displaying a few types of magnification change patterns which are previously stored in the copying machine. On the preset enlargement/reduction ratio display part 28, a magnification change pattern which is often used can be selected. The group of buttons 29 for setting various special modes includes buttons which are used to set a mode for using the sorter 43, a mode for duplex copying, etc. The group of buttons 30 includes buttons which are used to select a magnification change pattern which is previously stored or to manually set a magnification. Further, the group of buttons 31 includes buttons which are used to select which one of the cassettes 52, 42*a* to 42*c* and the manual paper feeding tray 53 should feed a paper on which a copy image is to be formed.

The IR emit/receive part 3 receives optical data of infrared rays (IR) emitted from a portable terminal apparatus which will be described later, and transmits the optical data indicating IR to the portable terminal apparatus. Optical data received are converted into an electric signal and supplied to a control part disposed within the copying machine. Meanwhile, since the directivity of infrared rays transmitted and received among the apparatuses is set sufficiently high, even if two copying machines are disposed next to each other, for instance, malfunction will not occur.

Figure 4:
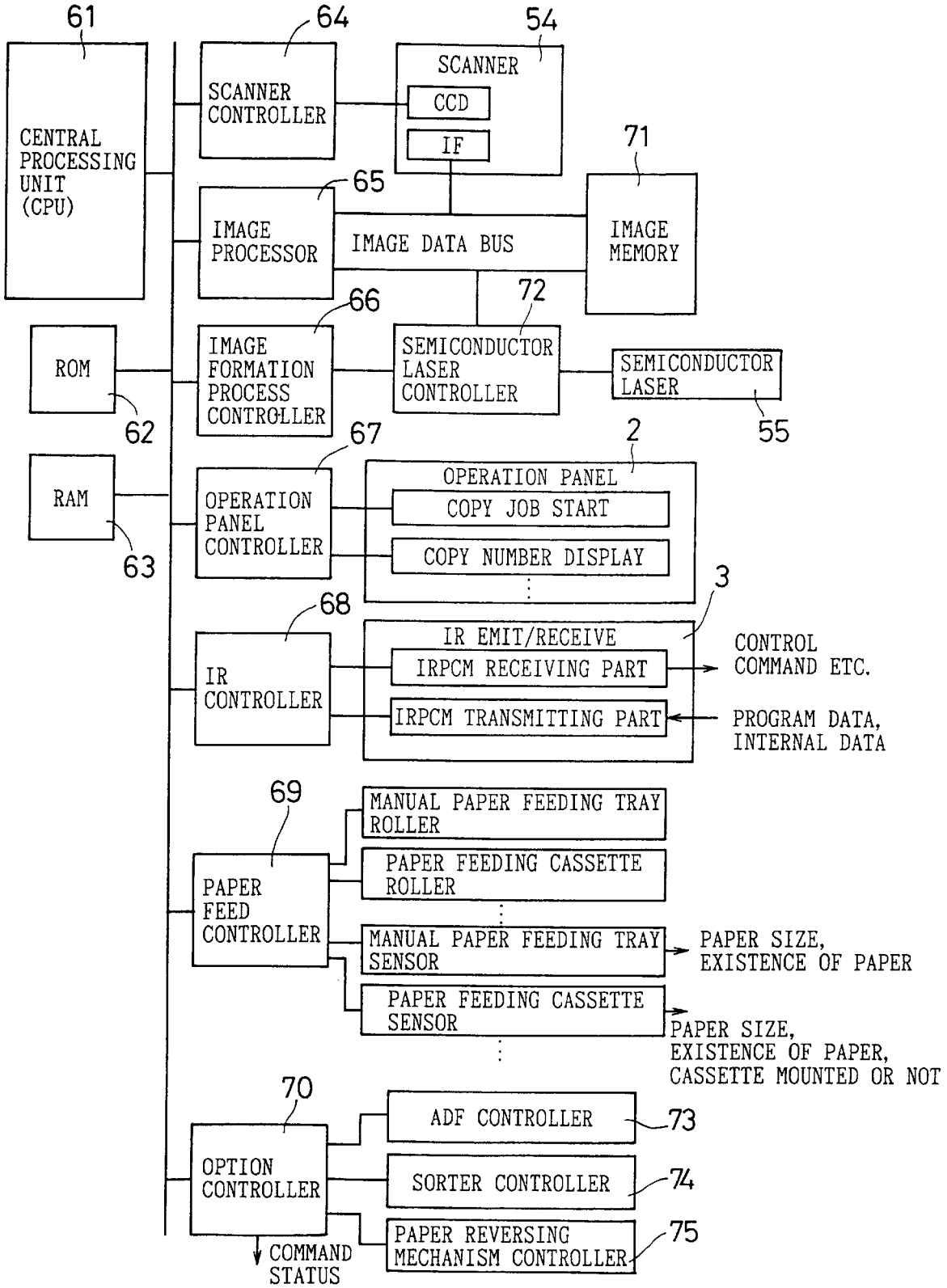
FIG. 4 is a block diagram showing a structure of a control part of the copying machine.

FIG. 4 is a system block diagram of the copying machine. A central control part (master CPU) 61 controls the entire copying machine. A program which is previously stored in a ROM 62 is used when the copying machine is controlled. Control programs for the copying machine which are stored in the ROM 62 and are to be transmitted to the terminal apparatus are composed of a plurality of hierarchical layers.

Figure 5:
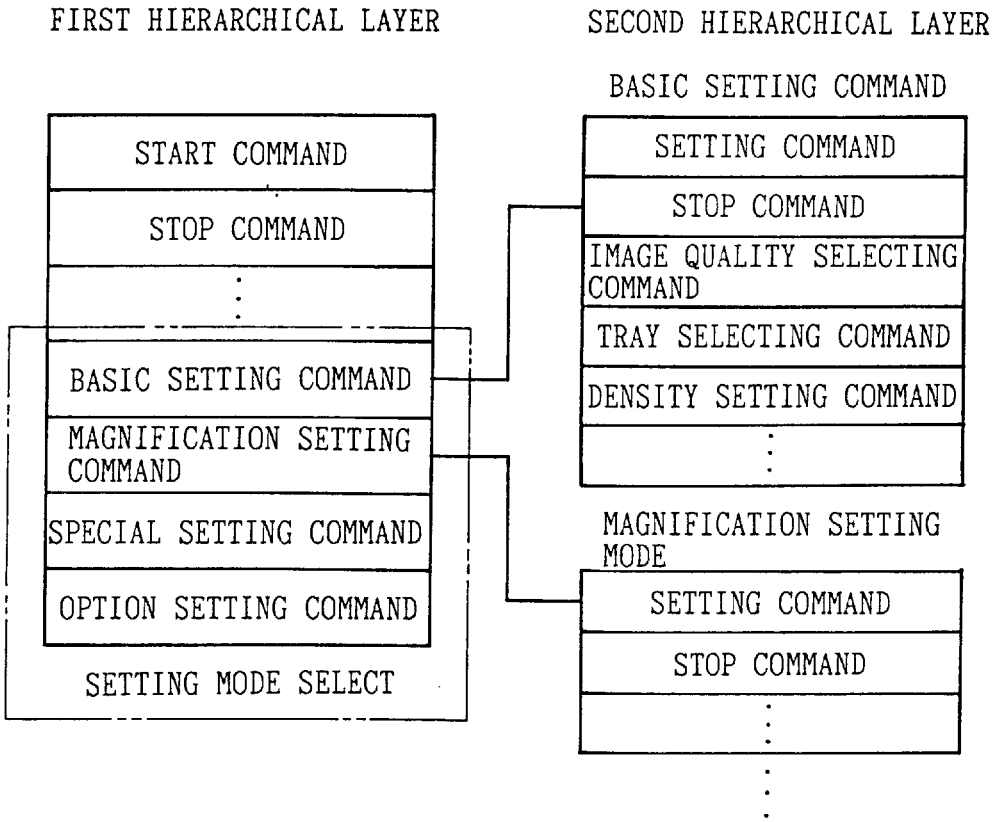
FIG. 5 is a view for describing a hierarchy of a control program.

FIG. 5 is a view for describing a hierarchy of a control program. A first hierarchical layer of the control program includes a start command, a stop command, commands for selecting a setting mode, etc. Further, as the commands for selecting a setting mode, the first hierarchical layer of the control program includes a basic setting command, a magnification setting command, a special setting command, an option setting command, etc. When the commands for selecting a setting mode are selected, the control sequence proceeds to a second hierarchical layer.

The second hierarchical layer is composed of setting modes which are associated to the four setting commands above. Each setting mode includes commands for executing a plurality of predetermined functions which are defined for each setting mode. For instance, when the basic setting command is selected at the first hierarchical layer, the control sequence proceeds to the basic setting mode of the second hierarchical layer. In the basic setting mode, in response to a predetermined key manipulation, the setting commands, the stop command, an image quality selecting command, a tray selecting command, a density setting command and the like are created. Each setting mode of the second hierarchical layer includes the setting commands and the stop command. When the setting commands are inputted, information specified by each selecting command is transmitted to the copying machine 1. After the information is transmitted in response to the setting commands, the control sequence returns to the first hierarchical layer. When the stop command is inputted, the control sequence returns to the first hierarchical layer without transmitting the information. The setting modes of the second hierarchical layer are independent from each other, and therefore, it is impossible to move to other setting mode within the second hierarchical layer.

The control program which is stored in the ROM 62 is prepared depending on types (versions) of the portable terminal apparatus which are classified according to types of a CPU which is disposed within the portable terminal apparatus, for instance. Hence, even among programs which perform the same operations, the programs for different types of portable terminal apparatuses have different codes. Therefore, it is possible to supply a control program which is suitable to any version of portable terminal apparatus. Referring to FIG. 4, again, a RAM 63 is an area for storing the internal information regarding the copying machine (e.g., an option mount condition, an error condition), status information, commands, etc. The internal information is a signal which indicates a condition of the processing apparatus, and an operator is informed of the internal information. The RAM 63 also stores a correlation table for specifying which configuration of the control program stored within the ROM 62 should be transmitted in response to an ID number which is transmitted from the portable terminal apparatus. The ID number is a number which is determined in advance for each portable terminal apparatus. Portable terminal apparatuses are identified by the ID numbers. Control parts (slave CPUs) 64 to 70 for controlling the respective operational parts of the copying machine are connected to the central control part 61.

A scanner control part 64 controls scanning performed by the scanner 54, turning on and off, etc., of the CCD 54*b*. Image data read by the CCD 54*b* of the scanner 54 are converted into an electric signal, and supplied to an image memory 71 or an image processing part 65 on an image bus. The image memory 71 stores the image data which are read by the scanner 54 or image data which are processed by the image processing part 65. The image processing part 65 performs rotating, smoothing, binarization or the like on image data which are supplied from the scanner 54 or read from the image memory 71 to thereby obtain data for forming a copy image. Image data which are processed by the image processing part 65 are stored in the image memory 71 or supplied to a controller 72 for a semiconductor laser of an image formation process control part 66. The image formation process control part 66 controls operational parts of the image formation processing part 56. The operational parts include the controller 72 for the semiconductor laser 55 described earlier.

An operation panel control part 67 provides the central control part 61 with a signal which corresponds to a manipulation of the inputting buttons which are disposed on the operation panel 2, and displays a condition which corresponds to an input within the display part on the operation panel 2. An IR control part 68 converts optical data which are supplied to the IR emit/receive part 3 into an electric signal, and supplies the electric signal to the central control part 61. The IR control part 68 also converts data which are to be transmitted to the portable terminal apparatus into optical data indicating IR, and transmits the optical data. A paper feeding control part 69 operates a paper feeding roller of one of the manual paper feeding tray 53 and the cassettes 52, 42*a* to 42*c* so that a paper is fed. The manual paper feeding tray 53 and the cassettes 52, 42*a* to 42*c* include sensors for detecting whether the cassettes are mounted, the size of papers contained, and the existence of a paper. The conditions of the sensors are supplied to the central control part 61.

An option control part 70 is a part to which control parts 73, 74 and 75 of the optional apparatuses are connected through connectors when the optional apparatuses such as the automatic document feeder 41, the sorter 43 and the paper reversing mechanism 44 are connected. An operation of each optional apparatus is controlled through the option control part 70.

A change in the condition of the copying machine 1 is detected by an associated one of the control parts 64 to 70, and internal information in the RAM 63 described above is rewritten in accordance with a result of the detection.

(2) Structure of Portable Terminal Apparatus

Figure 6:
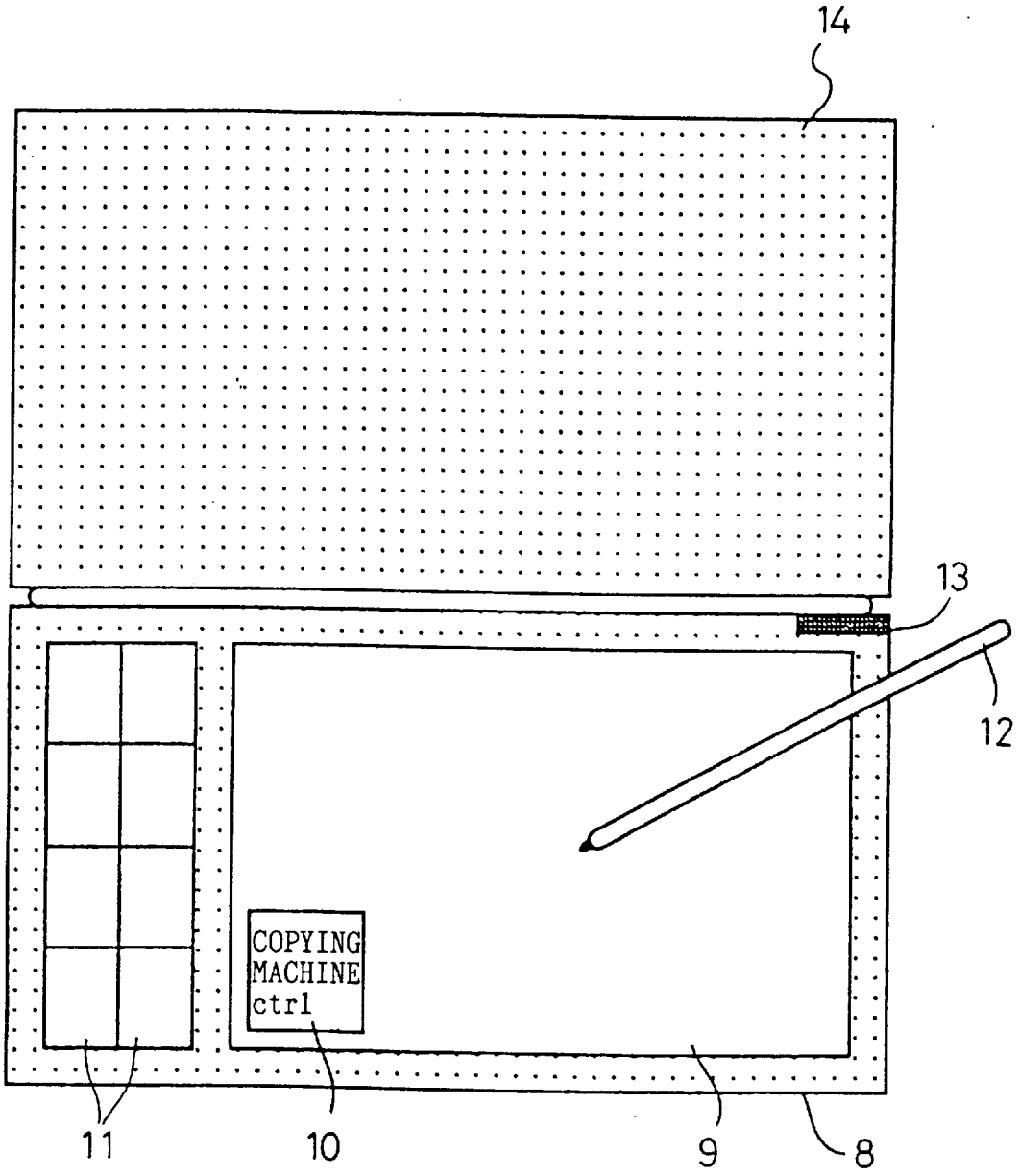
FIG. 6 is a view showing an appearance of a portable terminal apparatus which is a terminal apparatus of an embodiment of the invention.
Figure 7:
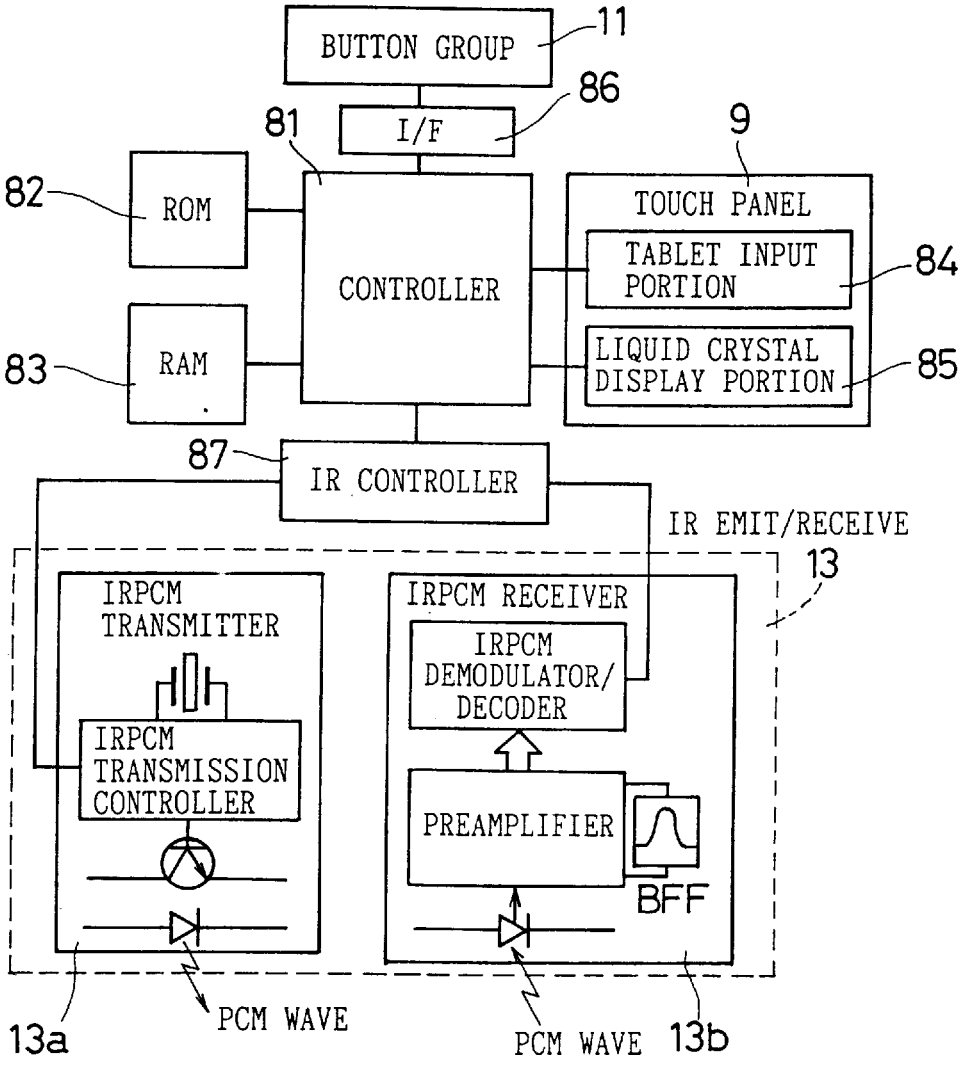
FIG. 7 is a block diagram showing a structure of a control part of the terminal apparatus.

Next, a structure of the portable terminal apparatus will be described. FIG. 6 is a view showing an appearance of the portable terminal apparatus, and FIG. 7 is a system block diagram of the portable terminal apparatus. The portable terminal apparatus according to the embodiment is a notebook type apparatus. The portable terminal apparatus is structured so that a touch panel 9 of a liquid crystal display is disposed in a main body 8 of the terminal apparatus which includes a lid 14 which can be opened and closed. An input is accepted on the touch panel 9, using an input pen 12. As shown in the drawings, for example, a copying machine control key 10 and the like to be manipulated to control the copying machine are displayed on the touch panel 9. To control the copying machine as described with reference to FIGS. 1 to 4, the copying machine control key 10 is pressed by the input pen 12, whereby controlling is started. Controlling uses communication by means of optical data through an emit/receive part 13 which is disposed in the portable terminal apparatus 8. A group of buttons 11 to be used for other special operation are disposed on the top surface of the portable terminal apparatus 8.

The portable terminal apparatus comprises a control part (CPU) 81 for controlling the entire portable terminal apparatus, a ROM 82 storing a program which is used to control the portable terminal apparatus, and a RAM 83 for storing various data which are needed to execute the program, data such as a document which is inputted on the portable terminal apparatus, and a program which is transmitted from the copying machine, i.e., the processing apparatus, to control the copying machine. The portable terminal apparatus also comprises an input part 84 for accepting an input from the touch panel 9, a display part 85 for displaying a liquid crystal display screen on the touch panel 9, an interface 86 for accepting an input from the buttons 11, and an IR control part 87 for transmitting and receiving optical data with the processing apparatus such as the copying machine. The IR control part 87 controls an infrared rays PCM transmitting part 13*a* and an infrared rays PCM receiving part 13*b* of the IR emit/receive part 13, to thereby transmit data to the copying machine and receive data from the copying machine.

(3) Sequence of Controlling

With respect to the copying machine and the portable terminal apparatus structured as above, a description will be given on a sequence in which the portable terminal apparatus controls an operation of the copying machine. FIGS. 16 to 21 are flow charts showing a sequence of processing performed by the copying machine, and FIGS. 22 to 29 are flow charts showing a sequence of processing performed by the portable terminal apparatus.

(I) Transmission of Control Program to Portable Terminal Apparatus

When a power supply switch is turned on, first, the copying machine 1 initializes the internal information and the internal mechanism, and performs warming up, (n1501). At the same time, flags such as an error eliminate mode flag are turned off (n1502). The error eliminate mode flag is a flag which indicates whether an error condition of the copying machine is eliminated. The error eliminate mode flag is at "H" (ON) when there is an error but is at "L" (OFF) when the error is eliminated. Further, as initialization, the IR emit/receive part 3 which receives optical data from the portable terminal apparatus is set to a light receive mode (n1503), and the copying machine 1 waits for an event (n1504). As herein termed, an "event" is either an input given by an operator on the operation panel 2, an error within the copying machine 1, an optional apparatus added, a change in the condition of the copying machine such as adding of papers, or receipt of data from the portable terminal apparatus (receipt of IR). Of these, a description will be given on processing associated with transmission and receipt of a program.

When an event input is receipt of IR, processing which corresponds to the received contents is performed (n1511). For instance, when received data are a code which requires transmission of a program, from among the received IR data, a hierarchical layer of the program which is demanded to be transmitted and ID number data of a transmitter are read, and the demanded program is then transmitted to the portable terminal apparatus 8 after storing the demanded program in a transmission buffer once (n1801→n1802→n1803). The internal information regarding the copying machine which corresponds to the demanded program is also transmitted to the portable terminal apparatus 8 (n1804→n1805). The internal information regarding the copying machine indicates an error condition within the copying machine (e.g., jam), an option mount condition of the copying machine, the existence of papers in a paper feeding cassette, etc.

Figure 9:
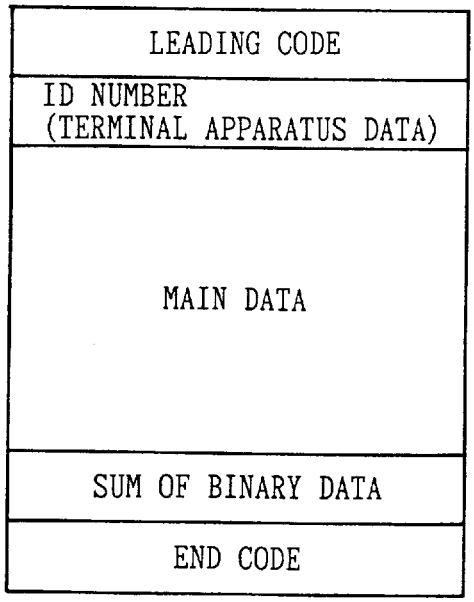
FIG. 9 is a view showing a structure of data which are transmitted between the copying machine and the terminal apparatus.

Data transmitted and received between the copying machine 1 and the portable terminal apparatus 8 have a structure as that shown in FIG. 9. That is, there is a leading code at the top of the data, followed by an ID number of the transmitter equipment (portable terminal apparatus). The ID number is data which are necessary to identify a type of portable terminal apparatus. When the version of the portable terminal apparatus is low and the portable terminal apparatus has a small number of functions, for example, an accordingly simple control program is transmitted from the copying machine to the portable terminal apparatus. The ID number is followed by main data, which are further followed by data which indicate the sum of binary data from the top to the end of the main data. The data are used to check whether the data were normally transmitted or received. An end code indicating end of the data is located at the very end of the data.

On the other hand, the portable terminal apparatus 8 initializes its internal data when power is turned on and enters an event waiting condition (n2101→n2102). The event as herein referred to includes pressing of the copying machine control key 10, the buttons 11, other keys on the touch panel 9, etc. When the buttons 11, other keys on the touch panel 9 and the like are pressed, the portable terminal apparatus 8 operates as a regular portable terminal apparatus (n2105).

When the copying machine control key 10 is pressed, the portable terminal apparatus 8 enters a control mode for controlling the copying machine 1. To this end, it is necessary that control program for controlling the copying machine 1 is stored in the portable terminal apparatus 8. Therefore, the portable terminal apparatus 8 downloads a necessary control program from the copying machine 1. At such an occasion, the portable terminal apparatus 8 downloads only a currently required hierarchical layer from a plurality of hierarchical layers of the control program which is stored in the copying machine 1, thereby preventing problems such as a loss time due to unnecessary downloading and shortage of the memory within the portable terminal apparatus 8 for storing the program. Processing performed for the purpose above will be described below.

When the copying machine control key 10 is pressed, the portable terminal apparatus 8 sets a value N, which expresses a hierarchical layer of the control program for controlling the copying machine stored in the portable terminal apparatus 8, at 0 (n2103→n2104). The hierarchical layer N=0 of the control program for controlling the copying machine indicates that the control program for controlling the copying machine 1 is not stored in the portable terminal apparatus 8 (i.e., not downloaded). When the portable terminal apparatus 8 downloads a necessary hierarchical layer N of the control program, the portable terminal apparatus 8 sets a hierarchical layer to be downloaded to the hierarchical layer N and then downloads the hierarchical layer N of the control program (n2201→n2212→n2213). First the first hierarchical layer N=1of the control program is downloaded.

Figure 8:
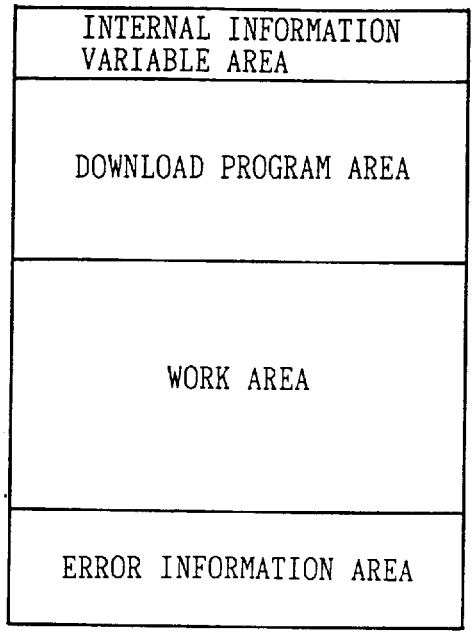
FIG. 8 is a view showing a memory structure while the copying machine is controlled by the terminal apparatus.

To download the control program, first the RAM 83 disposed within the portable terminal apparatus 8 is cleared (n2301). FIG. 8 is a view showing a data map of the RAM 83 with the copying machine control key 10 pressed. An internal information variable area stores internal information which is transmitted from the copying machine 1 (e.g., an error condition, an option mount condition, the existence of papers). A download program area is an area for storing the control program for controlling the copying machine transmitted from the copying machine. The portable terminal apparatus 8 execute the program which is stored in this area to thereby control the copying machine 1. A work area is used to execute the control program for controlling the data processing apparatus which is stored in the download program area. When there is an error within the copying machine 1, an error information area stores error information. An error condition which is stored in the internal information variable area indicates whether there is an error within the copying machine 1. As detailed information of the error condition, the error information area stores information which indicates in which part the error is created. Since the information which indicates whether there is an error and the detailed information expressing the error are stored separately from each other in this manner, it is only necessary to refer to the error information area when there is an error created. Thus, an area to be referred to when there is not an error can be reduced. At n2301, the respective areas are cleared to prepare for downloading of the N-th hierarchical layer of the control program. Following this, the portable terminal apparatus 8 sets the IR emit/receive part 13 to a transmission mode, and transmits a transmission demand code demanding transmission of the N-th hierarchical layer of the control program (n2302→n2303).

As described above, in response to the transmission demand code demanding transmission of the control program, the copying machine 1 transmits the N-th hierarchical layer of the control program and the internal information (n1801→n1805).

On the other hand, after transmitting the transmission demand code demanding transmission of the control program, the portable terminal apparatus 8 switches into a receipt mode (n2401), and waits for receipt of data from the copying machine 1 (n2402→n2404). Receiving data (control program) from the copying machine 1, the portable terminal apparatus 8 successively stores received data in a receipt buffer. Receiving an end code of the data (See FIG. 9), the portable terminal apparatus 8 judges whether there is a transmission/receipt error (n2405→n2406→n2407). Judgment of whether there is a transmission/receipt error is realized by comparing the slim of binary data contained in the data received from the copying machine 1 with the quantity of the data stored in the receipt buffer. While it is judged that the data are received normally when the two coincide with each other, it is judged that there is a receipt error when the two do not coincide with each other (n2801→n2802→n2803→n2804, n2805). The portable terminal apparatus 8 includes a flag R for judging whether there is a receipt error. The flag R is equal to 1 when data were received normally, whereas the flag R is equal to 0 when there is an error created. The error condition of receipt of data is judged in this manner. During receipt of data, if the data are not received within a certain time, a message indicating that there is a receipt error is displayed and the receipt error flag R becomes equal to 0 (n2402→n2403→n2408). When there is a receipt error (R=0), the transmission demand code demanding transmission of the control program is transmitted to the copying machine again, and receipt of the data (program) is repeated (n2305→n2302 . . . ). Thus, it is possible to judge a communication error when there is such a communication error. When there is a communication error, since retransmission of the program is automatically performed, redundant labor on an operator is avoided.

When the control program is normally received (R=1), after the received data are copied in an execution area, i.e., the download program area shown in FIG. 8, the portable terminal apparatus 8 is changed to the transmission mode, and a code indicating that the program was normally received is transmitted to the copying machine 1 (n2306→n2307). Following this, the portable terminal apparatus 8 receives the internal information regarding the copying machine 1 in a similar manner to that above for receiving the program. When the program was normally received, after copying of the received contents the internal information variable area which is shown in FIG. 8, the portable terminal apparatus 8 transmits a code indicative of this to the copying machine 1 and returns to a main routine (n2308→n2313).

In this manner, the control program for controlling the copying machine 1 and the internal information regarding the copying machine which corresponds to the program are transmitted to the portable terminal apparatus 8.

(II) Sequence of Controlling Copying Machine by Portable Terminal Apparatus

As described above, at n1504, the copying machine 1 waits for an event input. When an event input is an input given by an operator on the operation panel 2, the copying machine 1 performs normal copying based on inputted data (n1505). When an event input is control commands which are received from the portable terminal apparatus 8, the copying machine 1 successively stores the received control commands (n1511; n1801→n1806→n1807).

When the copying machine control key 10 is pressed, the portable terminal apparatus 8 enters a mode in which the portable terminal apparatus 8 controls the copying machine 1. When the program for controlling the copying machine 1 is stored in the portable terminal apparatus 8 (N≠0), the portable terminal apparatus 8 enters processing for actually controlling the copying machine 1 (n2201). First, an execution pointer (program counter) of the program is moved to the top of the download program area (n2202), and a default value of data which is necessary to execute the program stored in this area is set while referring to the data stored in the internal information variable area shown in FIG. 8 (n2203). Since the portable terminal apparatus 8 stores the internal information regarding the copying machine 1 which was received when the program for controlling the copying machine 1 was received at n2213, the internal information is used as the default value. The internal information regarding the copying machine 1 is transmitted every time the control program is transmitted from the copying machine 1. The keys are pressed under this condition to wait for an event such as an IR message (n2204), and corresponding processing is executed depending on the contents of the event.

Figure 10:
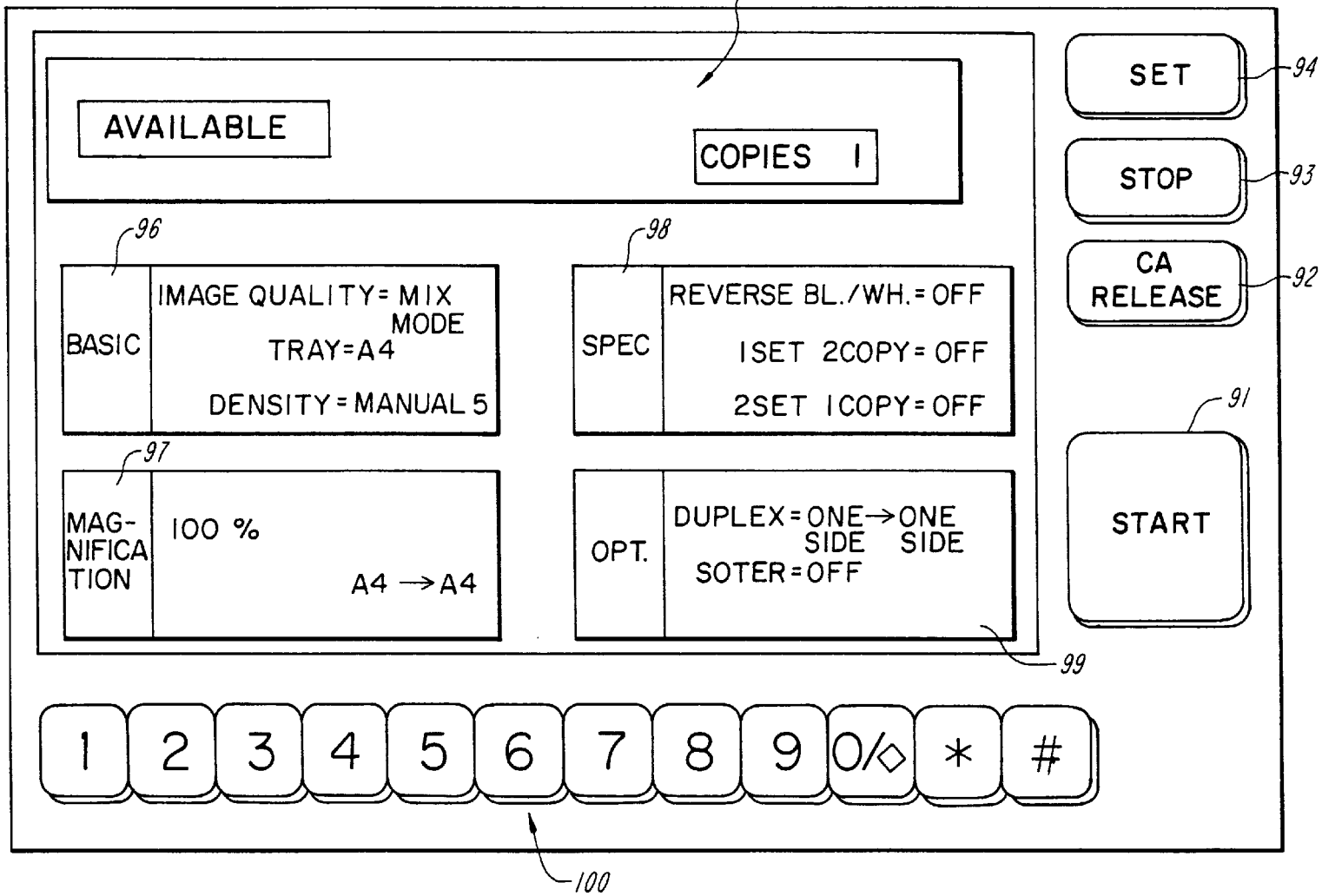
FIG. 10 is a view showing an example of a display on the terminal apparatus while the copying machine is controlled by the terminal apparatus.

Now, a description will be given on a display on the touch panel 9 of the portable terminal apparatus 8 during execution of the program for controlling the copying machine. FIG. 10 is a view showing a display condition during execution of the first hierarchical layer of the control program. The display for the first hierarchical layer includes a start key 91 which corresponds to the copy job start button 21 of the copying machine, an all clear key 92, ten numerical keys 100, a display part 95 for displaying the number of copies and a condition of current copying, a basic setting key 96 for selecting a copy image quality, a paper cassette and the like, a magnification setting key 97 for setting a magnification, a special mode setting key 98 for setting a special mode such as black/white reversing, an option setting key 99 for setting optional operations such as the paper reversing mechanism 44 and the sorter 43, a stop key 93, and a setting key 94.

Keys 96 to 100 are keys for setting a copying condition. A copying condition set using the keys 96 to 100 is transmitted to the copying machine 1 by means of manipulation of the setting key 94. When the setting key 94 is operated after the start key 91 is operated, the copying machine 1 executes copying. The all clear key 92 is a key for returning the setting within the portable terminal apparatus 8 to an initial state. The stop key 93 is a key for forcing the portable terminal apparatus to stop controlling the copying machine. Since copying is executed by operating the setting key 94 after the start key 91 as described above, when the start key 91 is manipulated without manipulating the setting key 94 and setting is not optimum setting, copying is not executed. The display part 95 displays an input condition on the portable terminal apparatus 8, a condition of the copying machine transmitted from the copying machine 1, etc.

Figure 11:
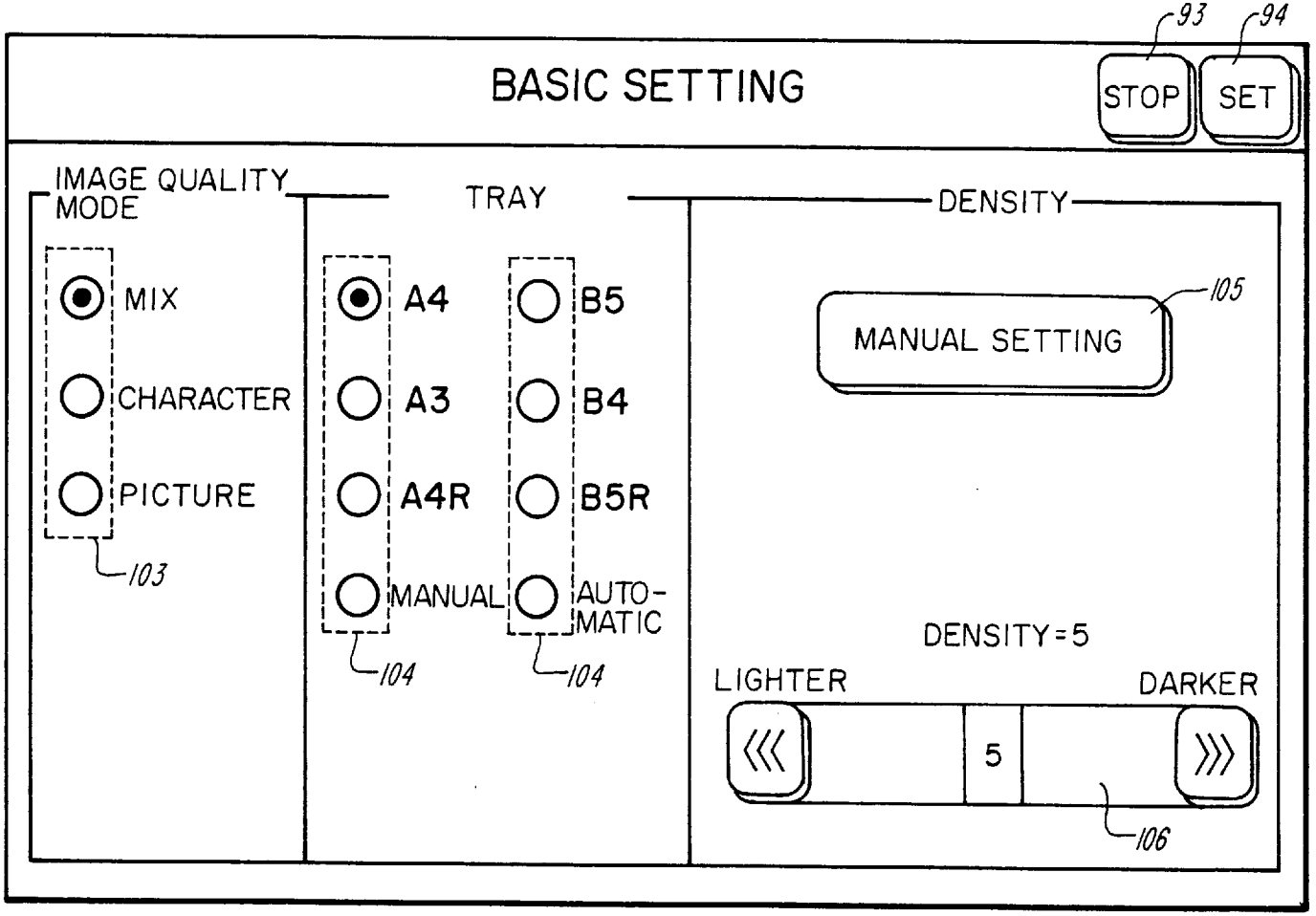
FIG. 11 is a view showing an example of a display on the terminal apparatus while the copying machine is controlled by the terminal apparatus.
Figure 12:
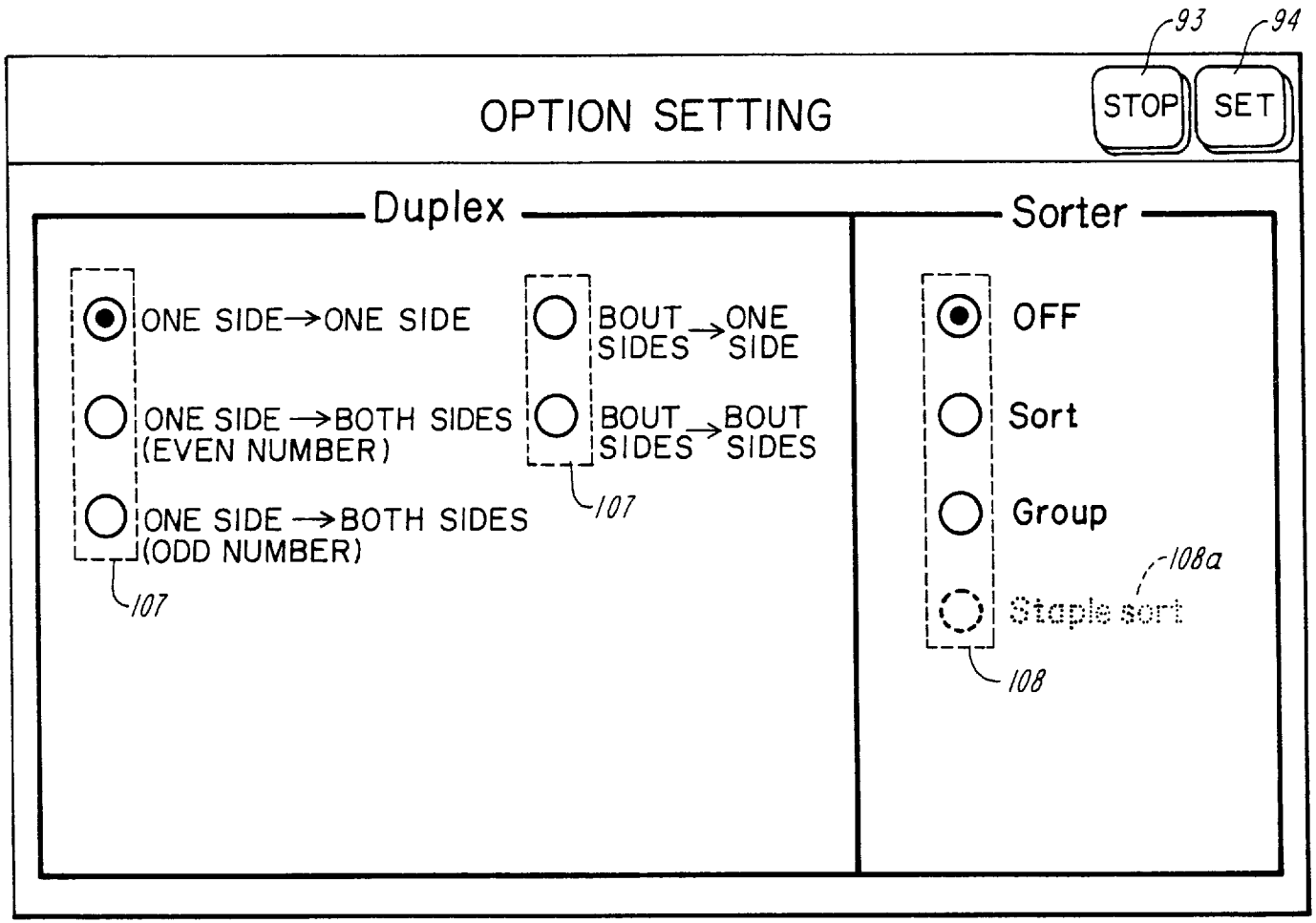
FIG. 12 is a view showing an example of a display on the terminal apparatus while the copying machine is controlled by the terminal apparatus.

The basic setting key 96, the magnification setting key 97, the special mode setting key 98 and the option setting key 99 are keys for setting a mode which includes a lower hierarchical layer. To set modes which correspond to manipulation of these keys, the hierarchical layers of lower levels of the control program are necessary. Hence, when any one of the keys 96 to 99 is operated, the portable terminal apparatus 8 downloads lower hierarchical layers (second hierarchical layer at seq.) of the control program from the copying machine 1 as described later. FIGS. 11 and 12 show an example of a display during execution of hierarchical layers of lower levels (second hierarchical layer et seq.) of the control program.

FIG. 11 shows an example of a display when a basic mode setting condition is invoked in response to manipulation of the basic setting key 96. In addition to the stop key 93 and the setting key 94, the display includes an image quality selection key 103 for selecting a copy image quality, a tray selection key 104 for selecting either one of manual paper feeding tray 53 and the paper feeding cassettes 52, 42*a* to 42*c*, a density setting mode selection key 105 for selecting manual setting/automatic setting of an image density, a density setting key 106 for setting a density grade in a manual density setting mode. The image quality selection key 103 and the tray selection key 104 are each manipulated in such a manner that one of a plurality of keys is operated to select a desired condition. The respective key portions also serve as display areas for displaying a selected condition, and a displayed color of an operated key portion changes. Every time the density setting mode selection key 105 is operated, the manual setting and the automatic setting are alternately switched and a selected condition is displayed in the key portion. When the density setting key 106 is pressed, the density grade is switched and a selected density grade is displayed. When the setting key 94 is pressed after the respective conditions are selected, set data are transmitted to the copying machine 1. After the data are transmitted, the display returns to the screen as that shown in FIG. 9.

FIG. 12 shows an example of a display when an option mode setting condition is invoked in response to manipulation of the option setting key 99. In addition to the stop key 93 and the setting key 94, the display includes duplex/simplex copying mode setting key 107 for setting a duplex/simplex copying mode using the paper reversing mechanism 44, a sorter mode setting key 108 for setting a mode in which the sorter 43 is used, etc. The duplex/simplex copying mode setting key 107 and the sorter mode setting key 108 are each manipulated in such a manner that one of a plurality of keys is operated to select a desired condition. The respective key portions also serve as display areas for displaying a selected condition, and a displayed color of an operated key portion changes. When the setting key 94 is pressed after the respective conditions are selected, set data are transmitted to the copying machine 1. After the data are transmitted, the display returns to the screen as that shown in FIG. 9.

When a paper size is selected by means of the tray selection key 104 or when an optional function is selected during option setting described above, a selected item is switched depending on a condition of the copying machine 1. In the case of FIG. 12, for instance, of the sorter mode setting key 108, a staple sort function selection key 108*a* is not active and therefore cannot be selected. This is because the staple sort function selection key 108*a* is in a passive condition in the portable terminal apparatus 8 under a condition which is set based on internal information which is transmitted from the copying machine 1, since information indicating that the stapling function is not added to the copying machine 1 is transmitted. This processing is executed at n2203.

When any input is received while waiting for an event, the portable terminal apparatus 8 executes processing which corresponds to the event (n2204). If the event input is inputting of a copying condition such as manipulation of the ten numerical keys 100 for inputting the number of copies, after storing the input in the work area of the RAM 83 (n2210), the portable terminal apparatus 8 returns to n2204 to wait for another event. Manipulation of the start key 91 is processed in a similar manner. If the event input is an input key for moving to the next hierarchical layer, such as manipulation of the basic setting key 96 and the magnification setting key 97 which have further hierarchical layers, the hierarchical layer N is incremented to thereby download the N-th hierarchical layer of the control program and the internal information from the copying machine 1 (n2209→n2208). Following this, the portable terminal apparatus 8 waits for an event at the N-th hierarchical layer (n2204). If the event input is manipulation of the setting key 94, the portable terminal apparatus 8 transmits the copying condition stored in the work area at n2210 described above to the copying machine 1 (n2205). After transmitting the copying condition, the portable terminal apparatus 8 decrements the hierarchical layer level N. The portable terminal apparatus 8 ends processing when the hierarchical layer level N is 0. If the hierarchical layer level N is not 0, the portable terminal apparatus 8 downloads an n-th hierarchical layer of the control program (n2206→n2208). Transmission of set data is, for instance, as follows.

First, a command which corresponds to each copying condition which is stored in the work area is created (n2501). The portable terminal apparatus 8 is set to the transmission mode, and the command is transmitted to the copying machine 1 (n2502→n2503). The transmission command includes the sum of binary data for judging a data transmission/receipt error, as shown in FIG. 9.

Receiving an end code of the control command which is transmitted from the portable terminal apparatus 8, the copying machine 1 judges whether there is a transmission/receipt error (n1808). Judgment of a transmission/receipt error is executed in the same manner as that performed within the portable terminal apparatus 8 shown in FIG. 29. The flag R is equal to 0 when there is an error created, and the copying machine 1 transmits a receipt error code to the portable terminal apparatus 8 in the transmission mode (n1809→n1810→n1811). On the other hand, the flag R is equal to 1 as a result of judgement of an error when the control command is normally received, and the copying machine 1 executes control command processing for analyzing the received control command (n1809→n1812).

In the control command processing, the command is analyzed from the top of the received control command, first, to thereby judge whether the control command is a command which is related to start of copying (n1901→n1902). If the control command is a command which is related to start of copying, the copying machine 1 starts copying under the copying conditions which were already received (n1903). On the other hand, if the control command is not a command which is related to start of copying, e.g., a command for selecting a paper feeding cassette, for example, the copying machine 1 executes processing such as replacement of paper feeding cassettes or the like in accordance with the command (n1905). Completing processing which corresponds to all received commands (n1904), the copying machine 1 returns to the IR receipt processing shown in FIG. 19, switches into the transmission mode and transmits a normal receipt code which is indicative of normal receipt to the portable terminal apparatus 8 (n1813→n1814).

The portable terminal apparatus 8 is changed to the receipt mode after transmitting the control command, and judges whether some data are transmitted from the copying machine 1 within a certain time (n2504→n2507). If there is no response from the copying machine 1 within the certain time, the portable terminal apparatus 8 judges that there is no copying machine 1 to communicate with, displays a message indicating this, and returns to a copying control routine (n2506→n2206). On the other hand, if there is a response from the copying machine 1 within the certain time and a result of the response is a code which is indicative of normal receipt, the portable terminal apparatus 8 returns to the copying control routine (n2505→n2507→n2508→n2206). However, if the result of the response is a code which is indicative of an error, the portable terminal apparatus 8 transmits the control command once again (n2508→n2502 . . . ).

During transmission of control commands, the command which is related to start of copying can be transmitted only when the first hierarchical layer of the control program for controlling the copying machine is operative. This is because the start key 91 belongs to the first hierarchical layer of the control program. Hence, during transmission of the set data above, if the control program stored in the portable terminal apparatus 8 to control the copying machine is operating at the first hierarchical, the portable terminal apparatus 8 judges that copying is started, exits from the copying control routine and returns to the original control routine which is set for the portable terminal apparatus 8 (n2206→n2207→n2104). However, when the control program is operating at the second hierarchical layer et seq., during transmission of the set data, the portable terminal apparatus 8 downloads higher hierarchical layer by one level of the control program and the internal information from the copying machine 1, and enters an event waiting condition again (n2206→n2207→n2208→n2201 . . . n2204). Although the embodiment indirectly judges that copying is started when the hierarchical layer is of the first, whether a command indicating start of copying is received may be directly judged. When such a command is received, the portable terminal apparatus 8 may automatically return to the original control routine from the copying control routine.

The portable terminal apparatus 8 controls an operation of the copying machine 1 in this manner.

(III) Processing to Deal With Change in Condition of Copying Machine (i) General Processing to Deal With Change in Condition The copying machine waits for an event input at n1504. If an event input is a change in the condition of the copying machine, the copying machine 1 judges the contents of the change in the condition and executes processing which corresponds to the change in the condition. For instance, if an event input is an error, the copying machine 1 turns on the error eliminate mode flag (n1506→n1507), waits until the error is eliminated and transmits this state to the portable terminal apparatus 8 (n1508→n1150). On the other hand, if an event input is not an error, e.g., a change in the internal information such as additional mounting of an optional apparatus and adding of papers into a paper feeding cassette, the copying machine 1 transmits the change in the internal information to the portable terminal apparatus 8, and returns to the waiting condition (n1509→n1503→n1504). Transmission of the state to the portable terminal apparatus 8 is realized in the following manner (n1508→n1509→n1710).

First, the copying machine 1 is set to the transmission mode. After transmitting a pre-transmission code as it is before transmission of the state, the copying machine 1 waits for a response from the portable terminal apparatus 8 (n1601→n1602→n1603→n1604).

On the other hand, the portable terminal apparatus 8 receives the pre-transmission code from the copying machine 1 (n2211), transmits a code which is indicative of a receivable condition to the copying machine 1, switches into the receipt mode and enters the receivable condition (n2601→n2602→n2603).

Receiving the code which is indicative of the receivable condition the portable terminal apparatus 8, the copying machine 1 temporarily stores current internal information regarding the copying machine in the transmission buffer, and executes transmission to the portable terminal apparatus 8 (n1605→n1606→n1607→n1608). On the other hand, if nothing is received within a certain time after transmitting the pre-transmission code, the copying machine 1 judges that there is no portable terminal apparatus 8 existing and returns to the event waiting condition (n1604→n1504). The copying machine 1 returns to the event waiting condition also when the portable terminal apparatus 8 is in a non-receivable condition (n1606→n1504).

The internal information regarding the copying machine stored in the transmission buffer of the copying machine 1 is transmitted to the portable terminal apparatus 8 (n2001→n2002→n2003). Receiving the internal information, the portable terminal apparatus 8 judges whether there is a transmission/receipt error (n2603), and receives the internal information regarding the copying machine once again if there is an error (n2604→n2605→n2606→n2603). The portable terminal apparatus 8 then rewrites the data stored in the RAM 83 in accordance with the received internal information. That is, if the received internal information is related to an error which is created within the copying machine, the portable terminal apparatus 8 rewrites the contents of the error information data area of the RAM 83 and transmits a code which is indicative of the end of receipt to the copying machine 1 (n2607→n2608). Meanwhile, if the received internal information is not related to an error but is related to addition of an option, feeding of papers, elimination of an error, etc., for instance, the portable terminal apparatus 8 rewrites the contents of the internal information variable area of the RAM 83 and transmits a code which is indicative of the end of receipt to the copying machine 1 (n2607→n2613). When the received information is related to elimination of an error within the copying machine, the portable terminal apparatus 8 also rewrites the contents of the error information data area (n2614→n2615). It is to be noted however that error information is rewritten when information indicating an error is not received by the portable terminal apparatus 8.

On the other hand, after transmitting the state, the copying machine 1 switches into the receipt mode and waits for a response from the portable terminal apparatus 8 (n2002→n2003→n2004→n2005). If an OK code which is indicative of the end of receipt (which is transmitted at n2608 or n2613) is transmitted from the portable terminal apparatus 8 within a certain time, the copying machine 1 returns to the event waiting condition (n2006→n1504). If a code demanding retransmission of the internal state is received within a certain time, the copying machine 1 transmits the internal information to the portable terminal apparatus 8 once again (n2007). If nothing is received, judging that the portable terminal apparatus 8 does not exist, the copying machine displays a message indicating this and returns to the event waiting condition (n2009→n1504). If a code other than the OK code and the code demanding retransmission is transmitted, judging that the communication condition is abnormal, the copying machine displays a message indicating this and returns to the event waiting condition (n2008→n1504).

The internal information is transmitted from the copying machine 1 to the portable terminal apparatus 8 in this manner, whereby the portable terminal apparatus 8 always receives latest information such as the error condition, option mount condition, feeding of papers, etc., within the copying machine. If a message transmitted from the copying machine 1 is not related to an error, the portable terminal apparatus 8 returns to n2204 and enters the event waiting condition.

(ii) Processing to Deal With Error

With respect to creation of an error among changes in the condition of the copying machine, in particular, the portable terminal apparatus 8 is well informed of the condition of the error. When receiving information indicating that an error is created, the portable terminal apparatus 8 temporarily stores the conditions of the control program for the copying machine, which is currently executed on the portable terminal apparatus 8, in the work area, changes a value EN indicating the error hierarchical layer, to 0 (n2609→n2610), and executes processing to deal with the error (n2611). During the processing to deal with an error, the portable terminal apparatus 8 demands the copying machine 1 to transmit the program for eliminating the error (i.e, a control program for eliminating an error), first (n2701→n2702). The value EN which indicates an error hierarchical layer is used when an error is created over hierarchical layers. The value EN is used in the error eliminating control program which will be described later. The error eliminating control program indicates a method of eliminating an error, and is composed of hierarchical layers by error eliminating steps.

On the other hand, transmitting information which is indicative of the error, the copying machine 1 switches into the receipt mode and waits for a response from the portable terminal apparatus 8. If there is no response within a certain time, the copying machine 1 turns off the error eliminate mode flag and returns to the event waiting condition (n1701→n1702→n1703→n1705, n1704). Meanwhile, if there is a response from the portable terminal apparatus 8 and the contents of the response are a demand for the program for eliminating the error, the copying machine 1 executes the following processing (n1706). First, the copying machine 1 judges whether there is an error within the copying machine 1 (n1707). If there is an error, the copying machine 1 retrieves the condition of the error and other internal information within the copying machine 1 and transmits a corresponding error eliminating control program to the portable terminal apparatus 8 (n1708→n1709→n1710→n1711).

If there is no error within the copying machine 1, the copying machine 1 supplies elimination completion data to the transmission buffer, turns off the error eliminate mode flag, and returns to the event waiting condition (n1712→n1713). If the contents of the response are not a demand for the program for eliminating the error, the copying machine 1 executes the IR receipt processing (n1714).

The portable terminal apparatus 8 receives the error eliminating control program from the copying machine 1 and stores the error eliminating control program (n2703). When the program is not normally received, the copying machine 1 displays this, restores the condition data which were stored in the work area, and returns to the event waiting condition (n2704→n2705→n2612→n2204). When the error eliminating control program is normally received, the copying machine 1 executes the error eliminating control program and enters the event waiting condition (n2706→n2707, n2709). An event which is waited here is either manipulation of a key or transmission of data from the copying machine.

Figure 13:
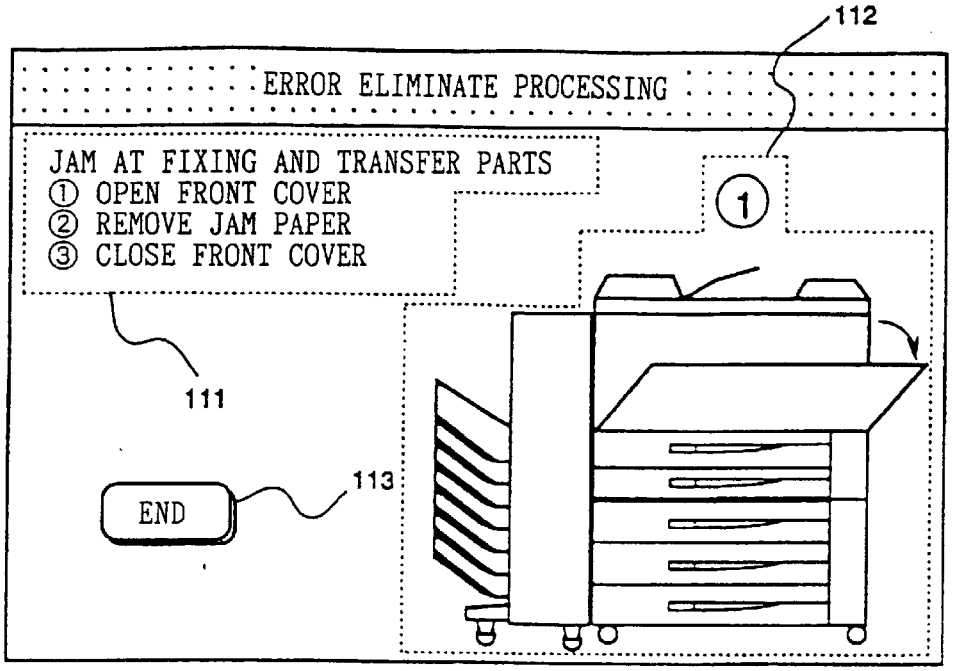
FIG. 13 is a view showing an example of a display on the terminal apparatus while there is an error within the processing apparatus.
Figure 14:
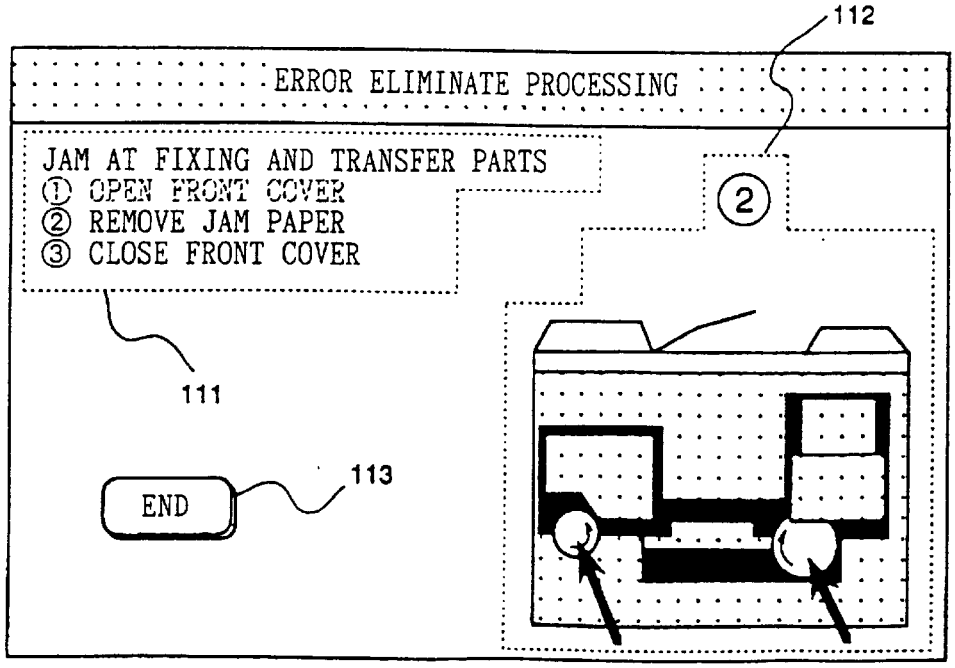
FIG. 14 is a view showing an example of a display on the terminal apparatus while there is an error within the processing apparatus.
Figure 15:
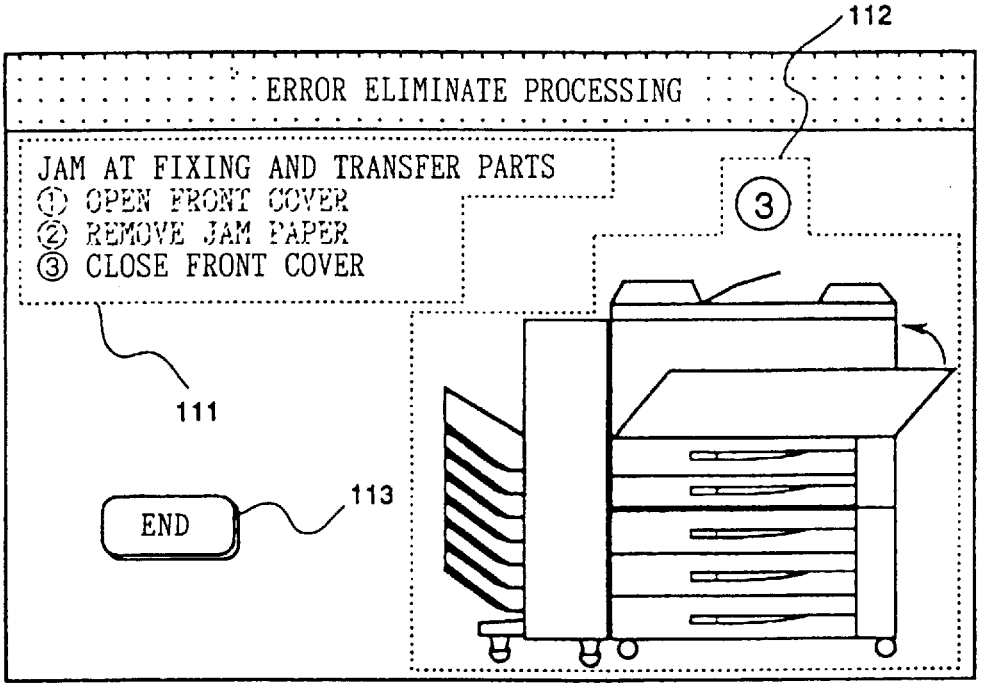
FIG. 15 is a view showing an example of a display on the terminal apparatus while there is an error within the processing apparatus.
Figure 16:
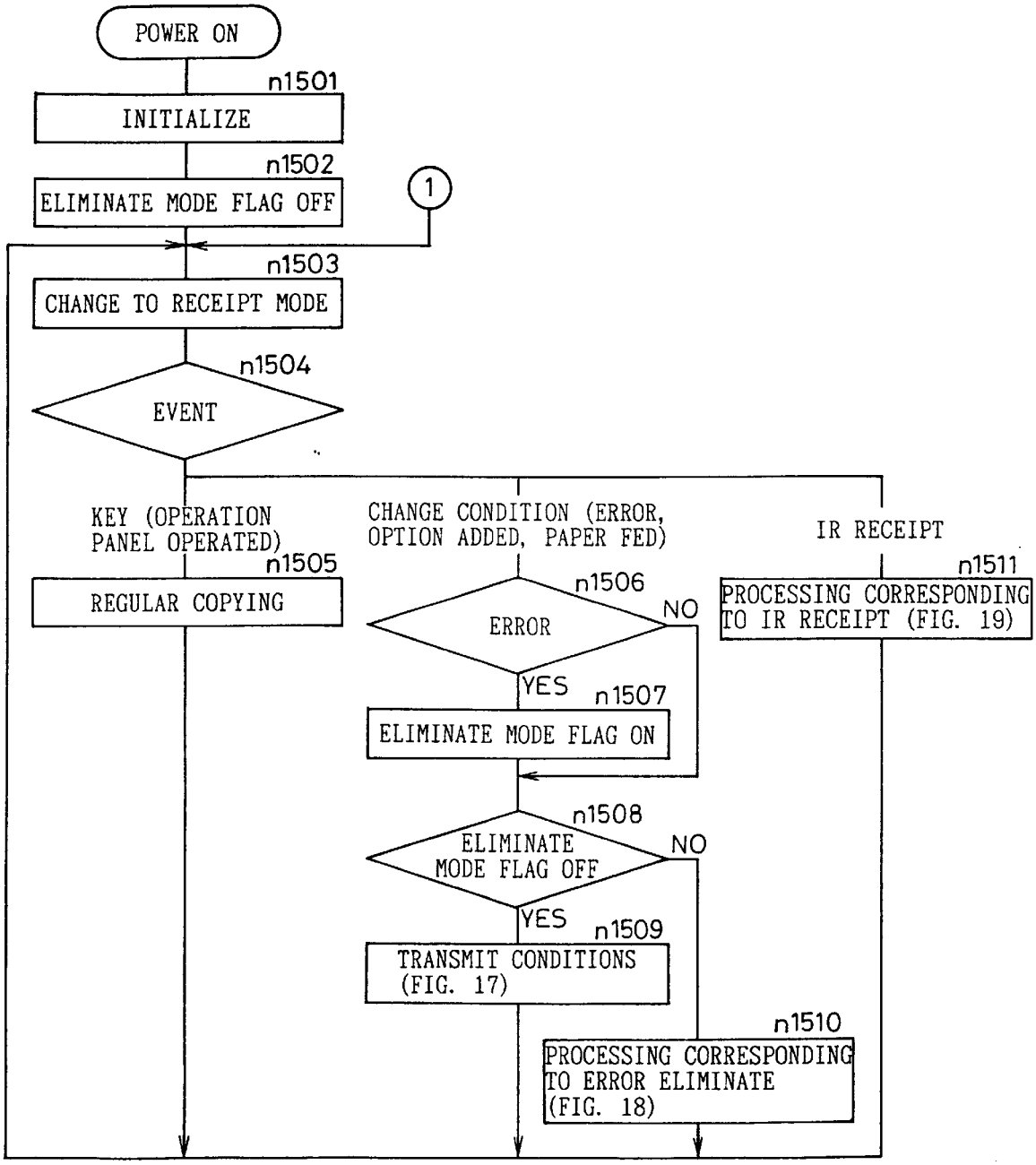
FIG. 16 is a flow chart showing a sequence of processing of a copying machine of an embodiment of the invention.
Figure 17:
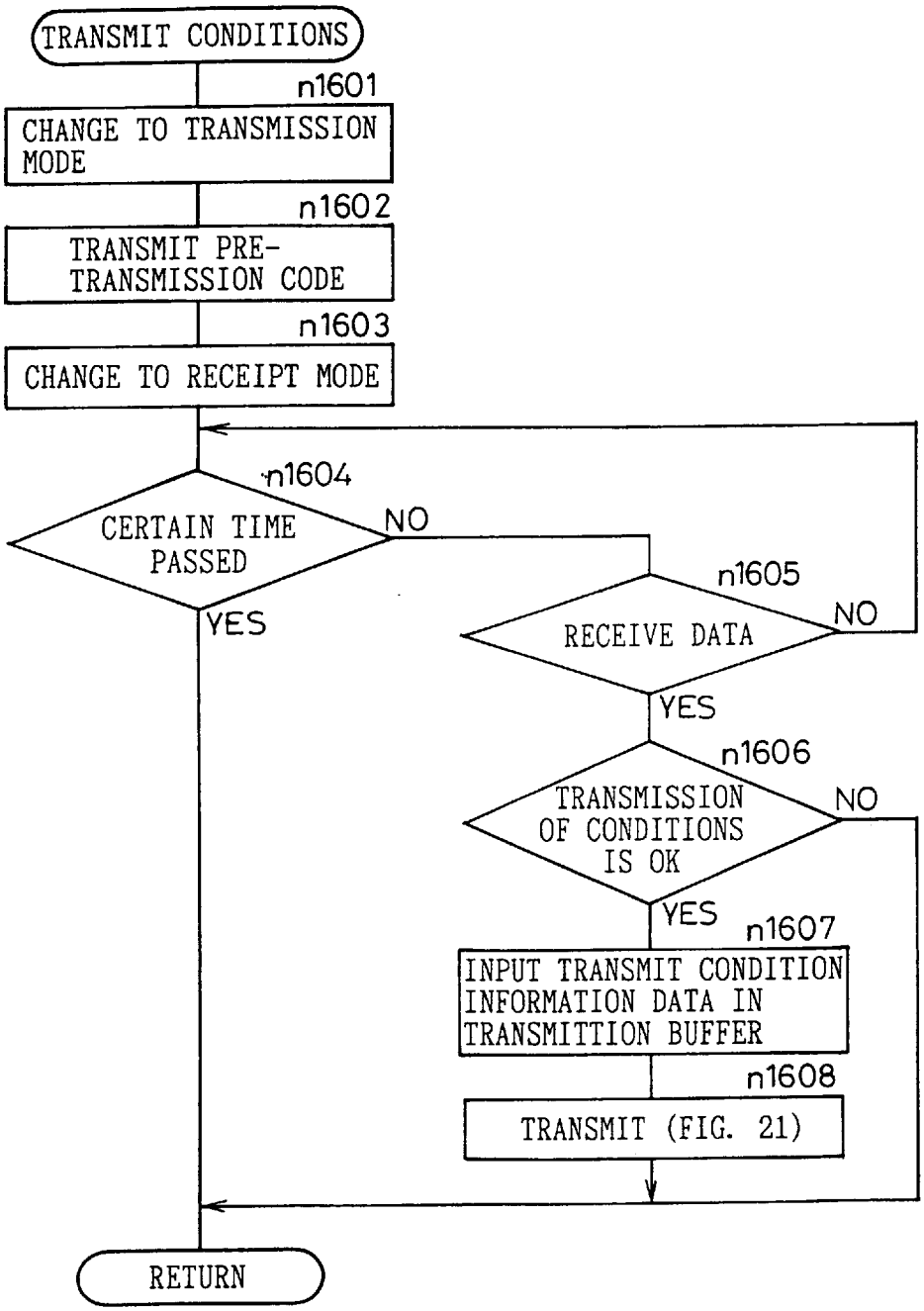
FIG. 17 is a flow chart showing a sequence of processing of the copying machine of the embodiment of the invention.
Figure 18:
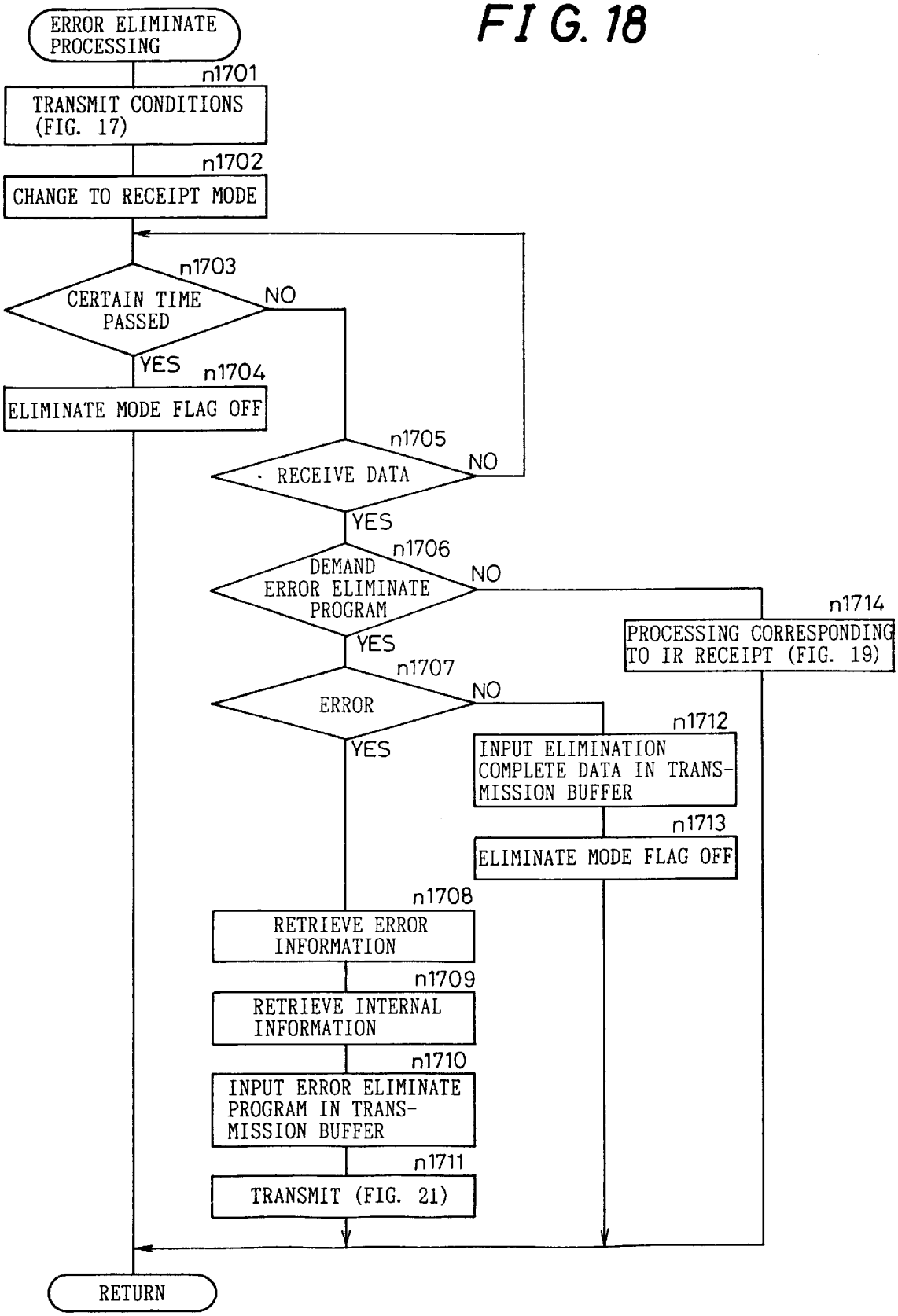
FIG. 18 is a flow chart showing a sequence of processing of the copying machine of the embodiment of the invention.
Figure 19:
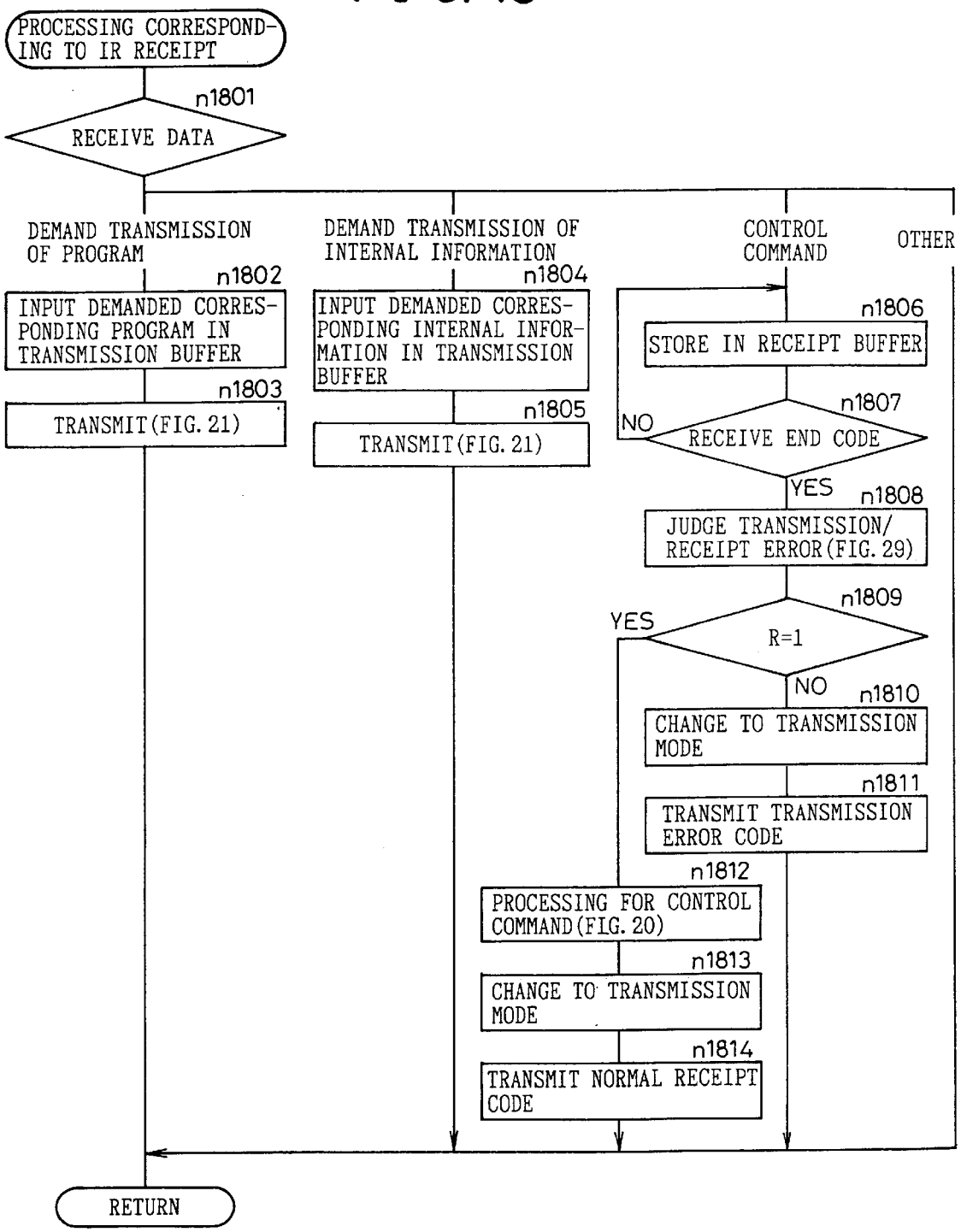
FIG. 19 is a flow chart showing a sequence of processing of the copying machine of the embodiment of the invention.
Figure 20:
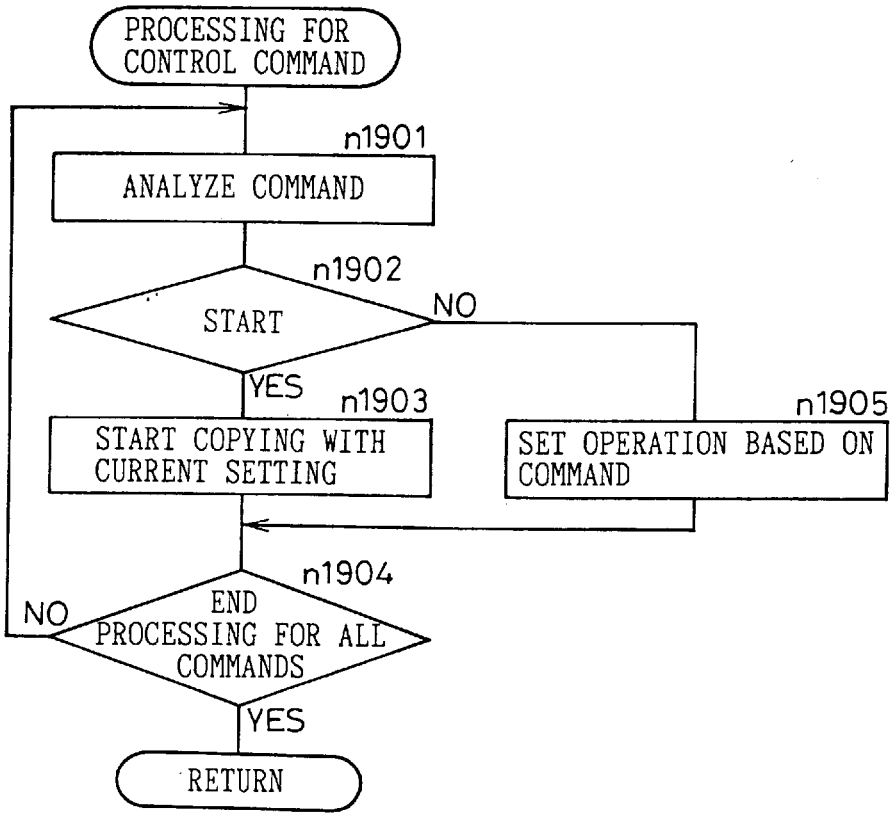
FIG. 20 is a flow chart showing a sequence of processing of the copying machine of the embodiment of the invention.
Figure 21:
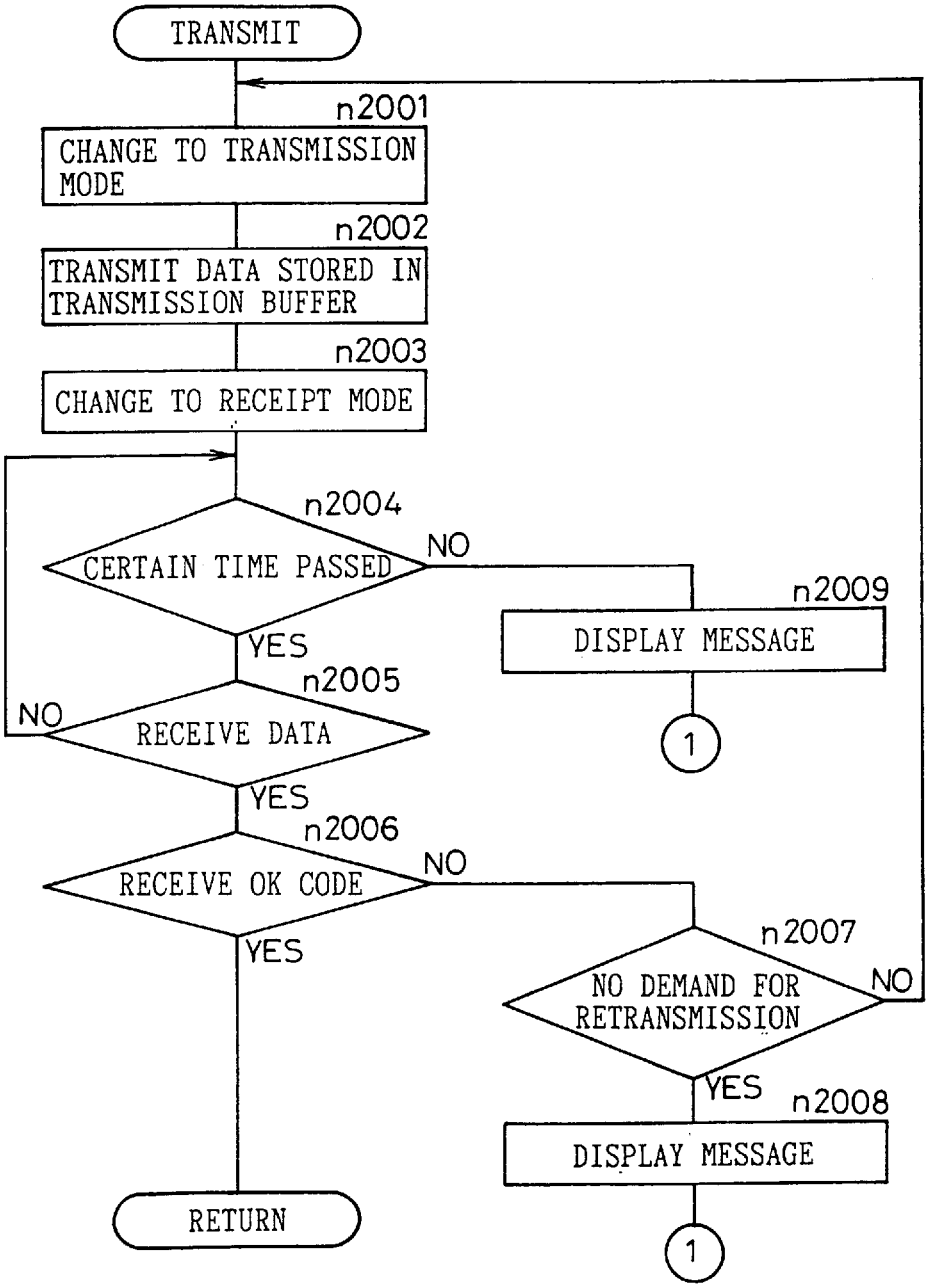
FIG. 21 is a flow chart showing a sequence of processing of the copying machine of the embodiment of the invention.

Errors which are created within the copying machine 1 include jamming of a paper, a scanning error by an optical system, an abnormal increase in the temperature of the fixing apparatus, etc. Although a description will be given here specifically on a jam error, other errors are processed in a similar manner. Now, it is assumed that papers get jammed at a fixing part and a transfer part of the copying machine. In response, the copying machine 1 transmits a corresponding error eliminating control program to the portable terminal apparatus 8. The program includes display screens as those shown in FIGS. 13 to 15. Describing the display screens, displayed on the touch panel 9 of the portable terminal apparatus 8 are an instruction area 111 for displaying messages for each step of elimination of an error, a picture display area 112 for visually expressing the contents which are indicated in the instruction area 111 using a picture or the like, and an end key 113. Several processing steps must be executed to eliminate an error. Each step is expressed by an error hierarchical layer EN. In this example, for instance, the error hierarchical layer EN is expressed as three hierarchical layers (EN=3) of "(1) Open the front cover.", "(2) Remove JAM paper.", "(3) Close the front cover." Each error hierarchical layer has a display screen as that shown in FIG. 13 (EN=1), FIG. 14 (EN=2) or FIG. 15 (EN=3). When the error eliminating control program is transmitted, only a necessary hierarchical layer of the program is transmitted as in regular transmission of the control program. However, during transmission of the error eliminating control program, when the first hierarchical layer of the error eliminating control program is transmitted, which level in the hierarchy of the error eliminating control program is transmitted is transmitted as an initial value en. The value en is used to judge whether elimination of an error is completed. The end key 113 is used to force ending of the error eliminating control program, regardless of layer EN of the error hierarchy. For example, an elimination method can be understood only by looking at the display screen of FIG. 13. Since a user does not have to look for an elimination method for each hierarchical layer, the user may operate the end key 113 to prevent transmission/receipt of unnecessary data.

When the end key 113 is operated on the touch panel 9 of the portable terminal apparatus 8, the portable terminal apparatus 8 forces the processing to deal with the error to end, and returns to the condition before creation of the error and enters the event waiting condition (n2707→n2708→n2612→n2204). On the other hand, when the condition of the copying machine is transmitted from the copying machine 1, the portable terminal apparatus 8 receives the condition (n2709→n2711→n2712). When data other than the condition of the copying machine are transmitted from the copying machine 1 (n2710) or when an error is created during transmission/receipt of the transmission condition (n2713→n2714), judging that there is a communication error created, the portable terminal apparatus 8 displays a message indicative of this, returns to the condition before creation of the error and enters the event waiting condition (n2612→n2204).

Receiving the condition of the copying machine 1, the portable terminal apparatus 8 judges the contents of the condition (n2715). If the contents are processing which corresponds to the current error, the level EN of the error hierarchy layer is decremented (n2715→n2716). The portable terminal apparatus 8 then judges the current level EN of the error hierarchy. If processing of all error hierarchical layers is completed, the portable terminal apparatus 8 rewrites the error information stored in the RAM 83 and displays that the error is eliminated (n2717→n2718→n2719). However, if there is any hierarchical layer of the error hierarchy which remains unprocessed (EN≠en), the portable terminal apparatus 8 receives the next level in the hierarchy of the error eliminating control program and continues the error eliminating control program (n2706). More precisely, when the front cover of the copying machine 1 is opened under the condition indicated by the display screen of EN=3 shown in FIG. 13, the copying machine 1 transmits information indicating this to the portable terminal apparatus 8. In response to this, the portable terminal apparatus 8 judges that processing of the hierarchical layer of EN=3 is completed, moves to the hierarchical layer of EN=2, receives the second layer in the hierarchy of the error eliminating control program, and displays the display screen shown in FIG. 14. Processing of the next layer in the hierarchy of the error eliminating program is then executed.

Since a message regarding elimination of the error is displayed on the portable terminal apparatus 8 and an operator executes processing for eliminating the error in response to this, even when the display part of the copying machine 1 is hard to look at, the operator can eliminate the error while referring to the display part of the portable terminal apparatus 8. Hence, even if the copying machine is of a type which only informs of an error but does not execute an elimination method or of a type which indicates an elimination method, it is easier to eliminate an error than in a copying machine which only displays a display screen at one time.

Although the embodiment relates to a case where there is only one copying machine as the processing apparatus, the invention is enforced similarly even if the processing apparatus is a facsimile machine, for instance.

In other preferred embodiment of the invention, the processing apparatus is a facsimile apparatus which has a facsimile function, for example. The portable terminal apparatus for controlling the facsimile apparatus has the same structure as that of the portable terminal apparatus which is used in the embodiment, and therefore, the portable terminal apparatus will not be described.

Figure 22:
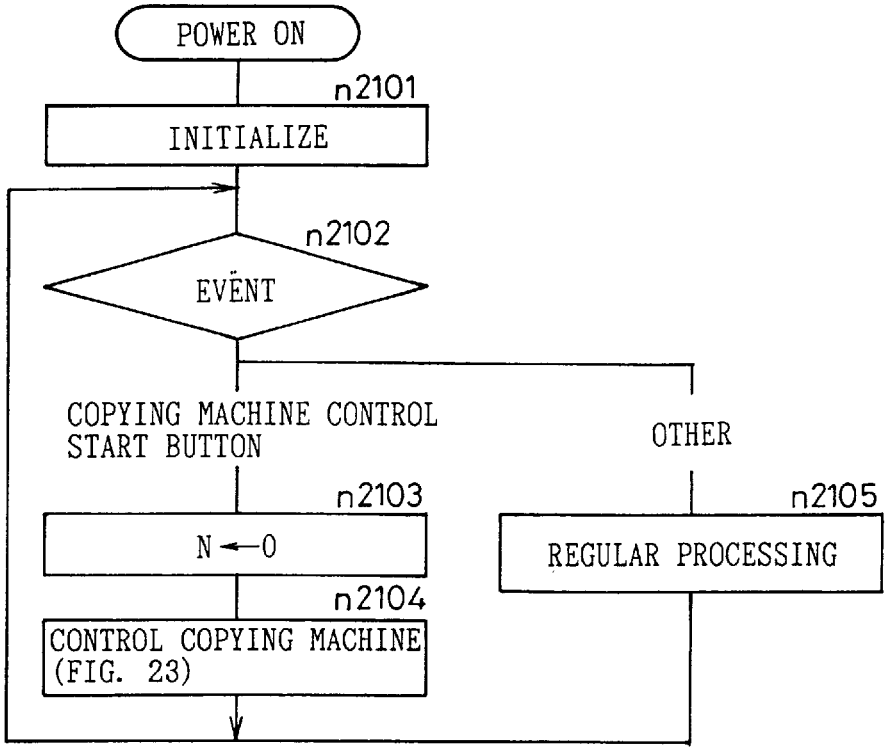
FIG. 22 is a flow chart showing a sequence of processing of a portable terminal apparatus of the embodiment of the invention.
Figure 23:
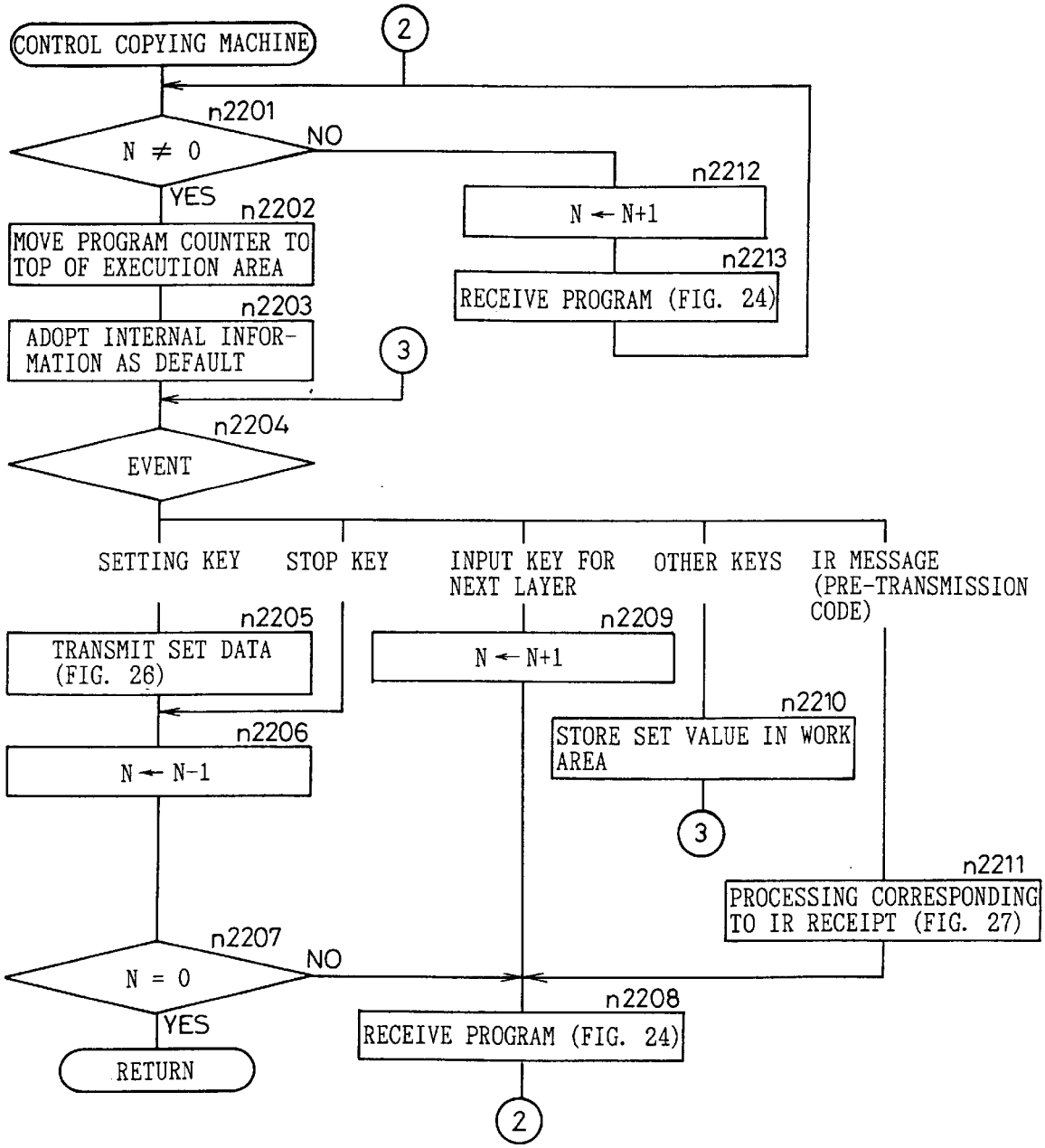
FIG. 23 is a flow chart showing a sequence of processing of the potable terminal apparatus of the embodiment of the invention.
Figure 24:
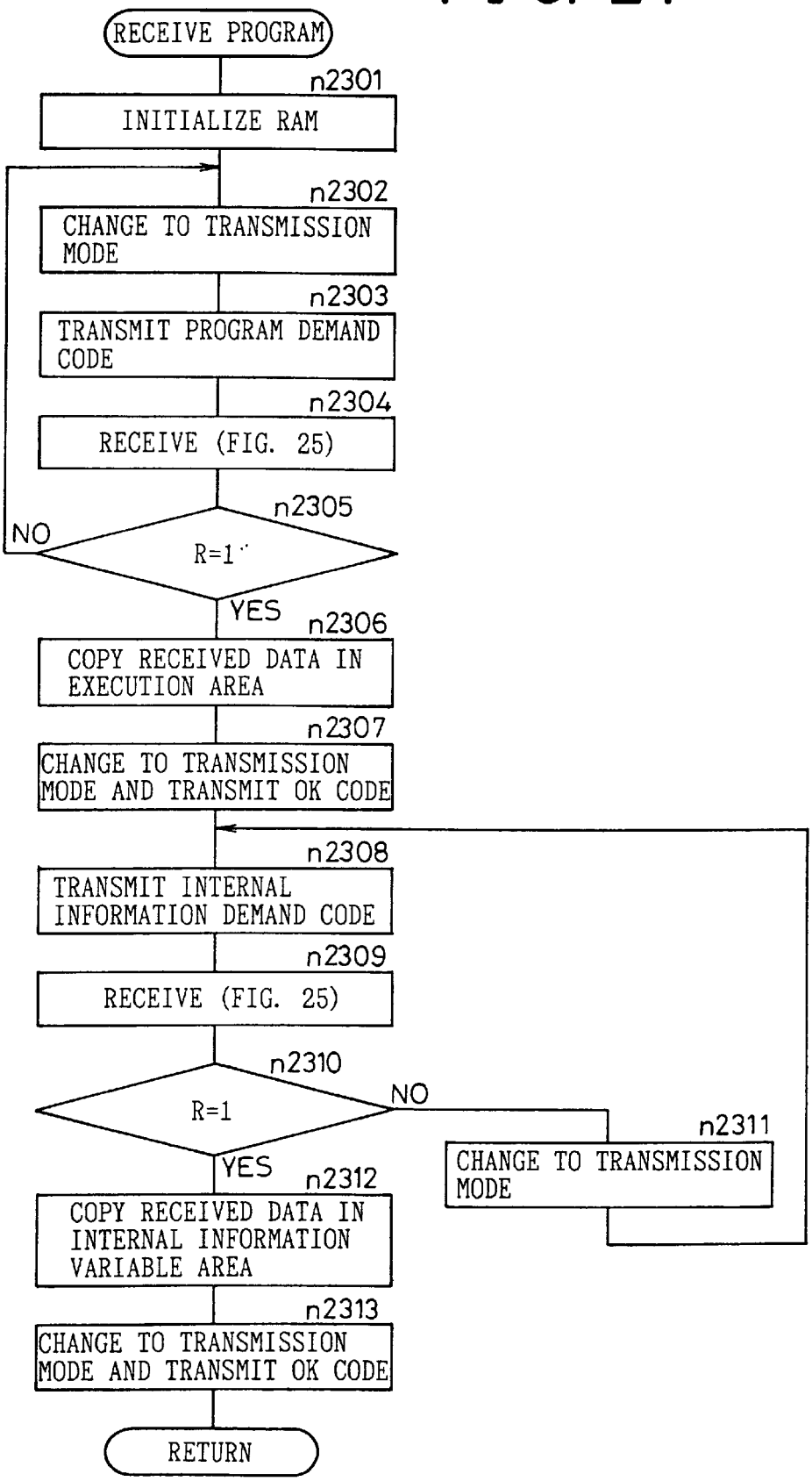
FIG. 24 is a flow chart showing a sequence of processing of the portable terminal apparatus of the embodiment of the invention.
Figure 25:
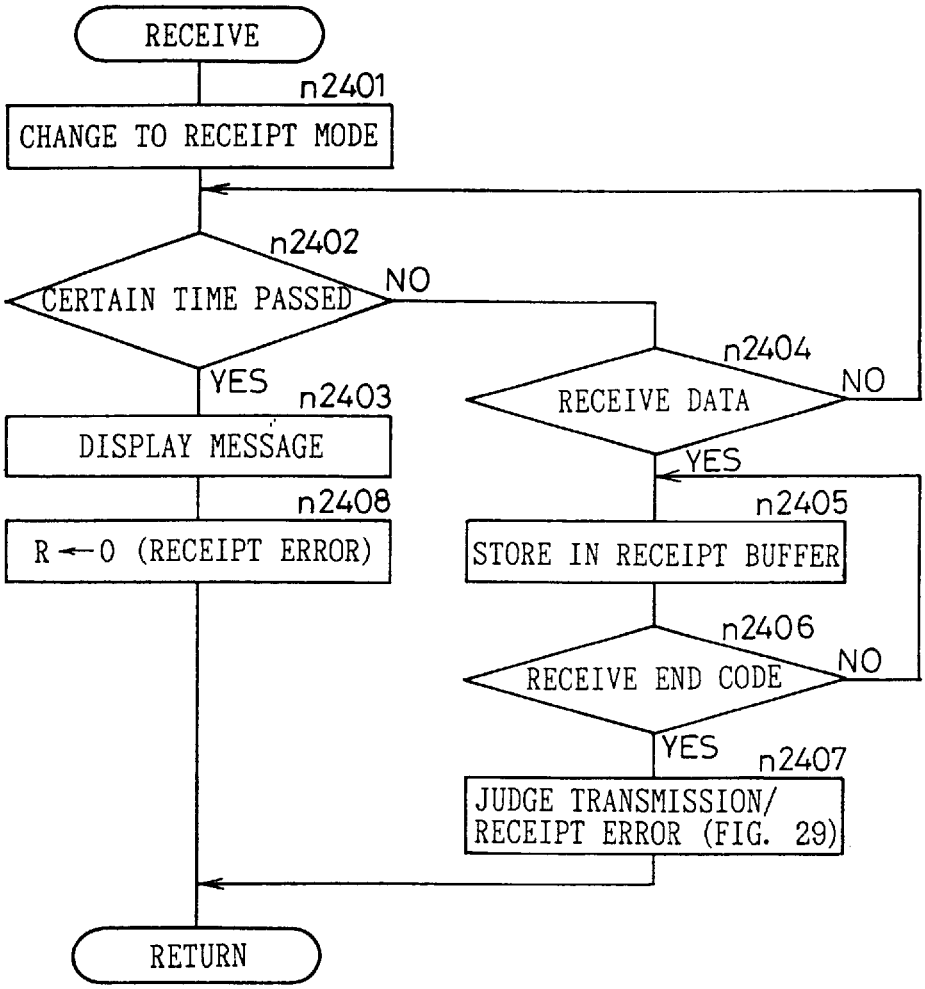
FIG. 25 is a flow chart showing a sequence of processing of the portable terminal apparatus of the embodiment of the invention.
Figure 26:
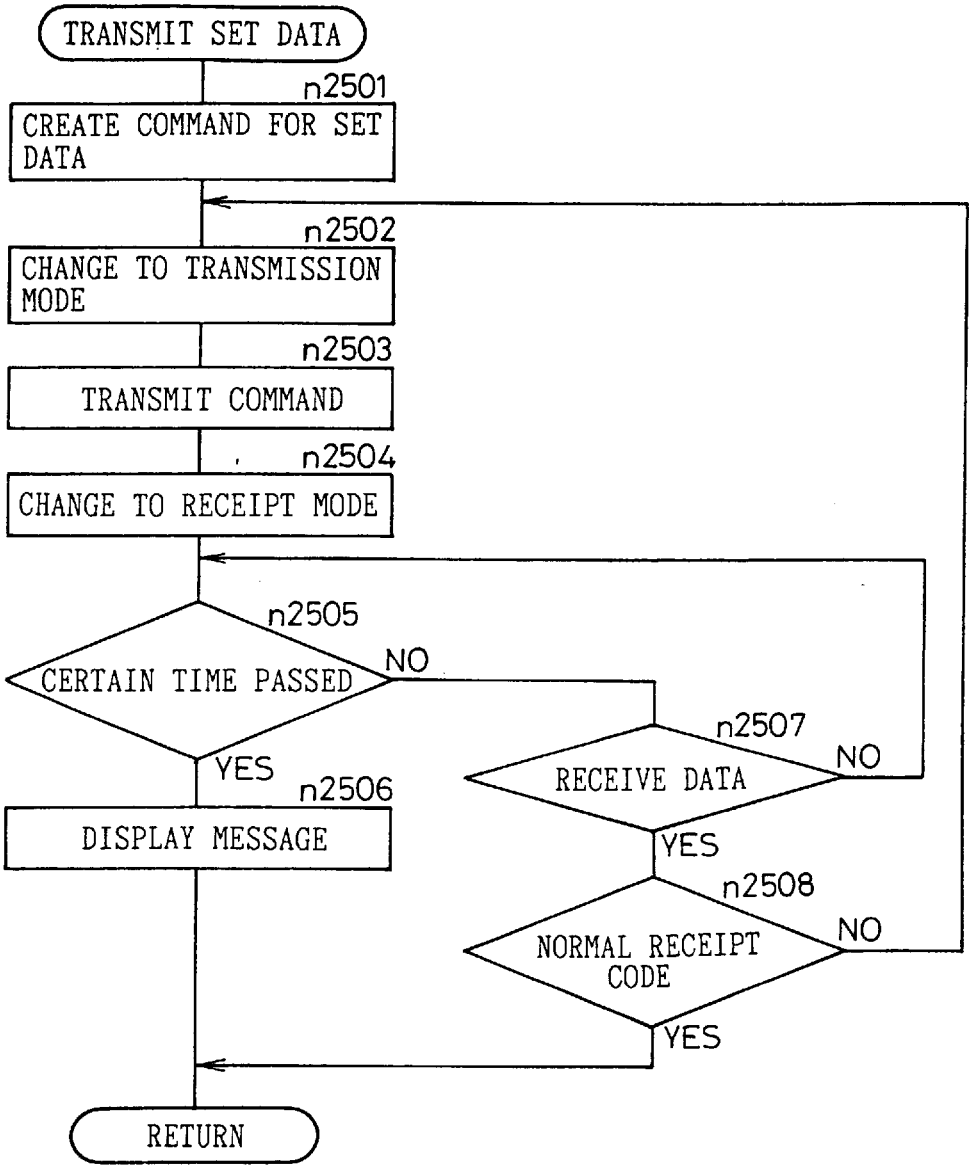
FIG. 26 is a flow chart showing a sequence of processing of the portable terminal apparatus of the embodiment of the invention.
Figure 27:
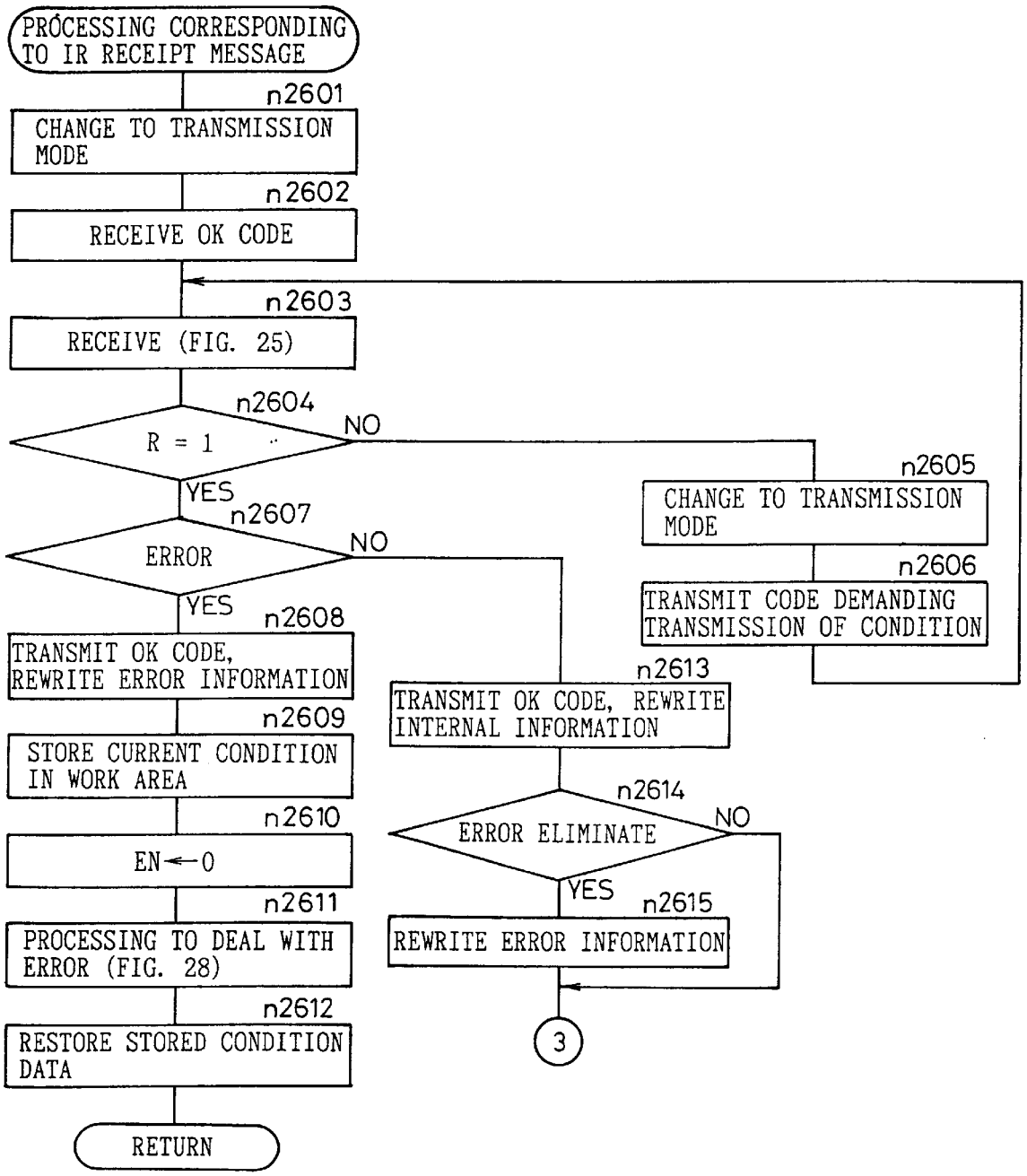
FIG. 27 is a flow chart showing a sequence of processing of the portable terminal apparatus of the embodiment of the invention.
Figure 28:
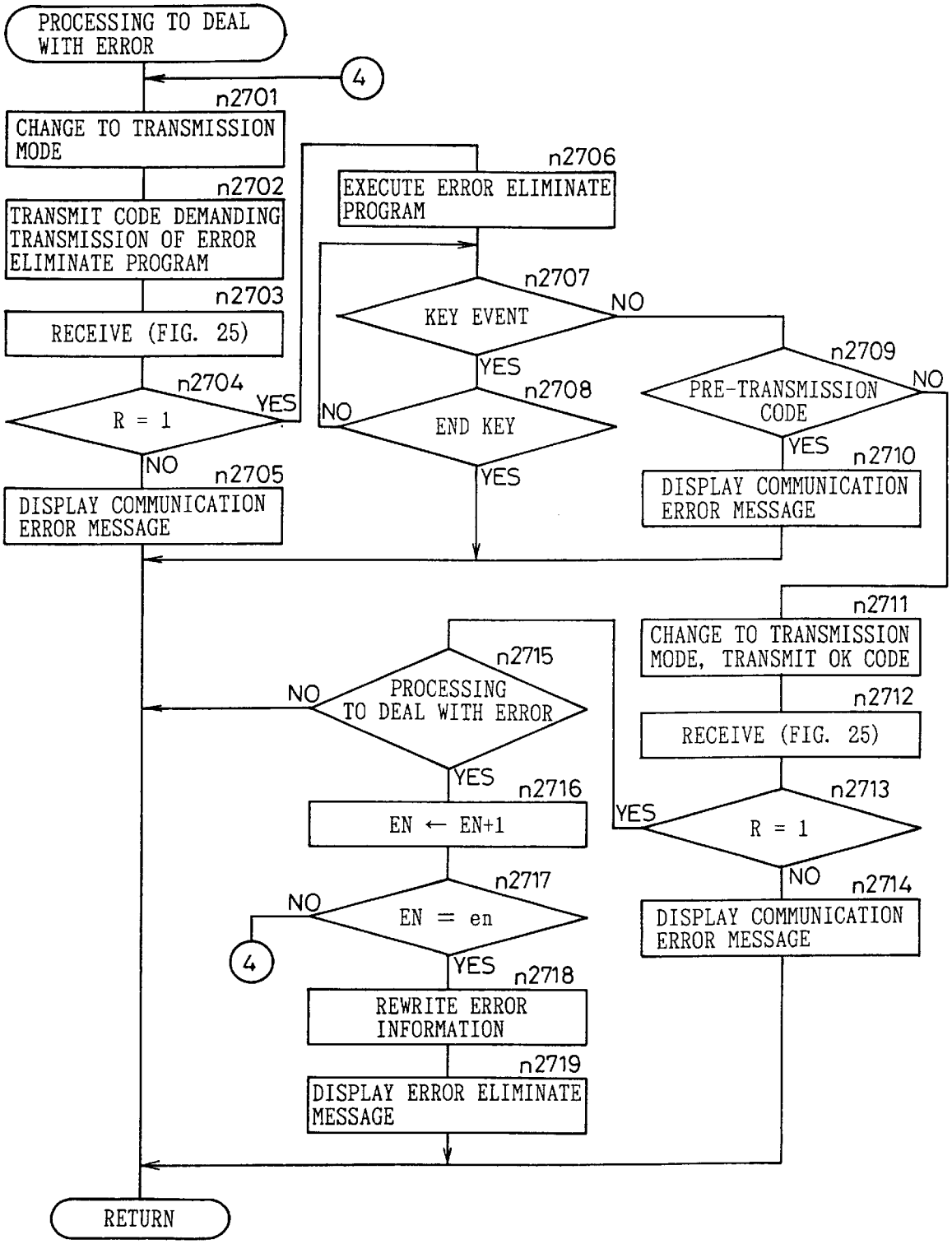
FIG. 28 is a flow chart showing a sequence of processing of the portable terminal apparatus of the embodiment of the invention.
Figure 29:
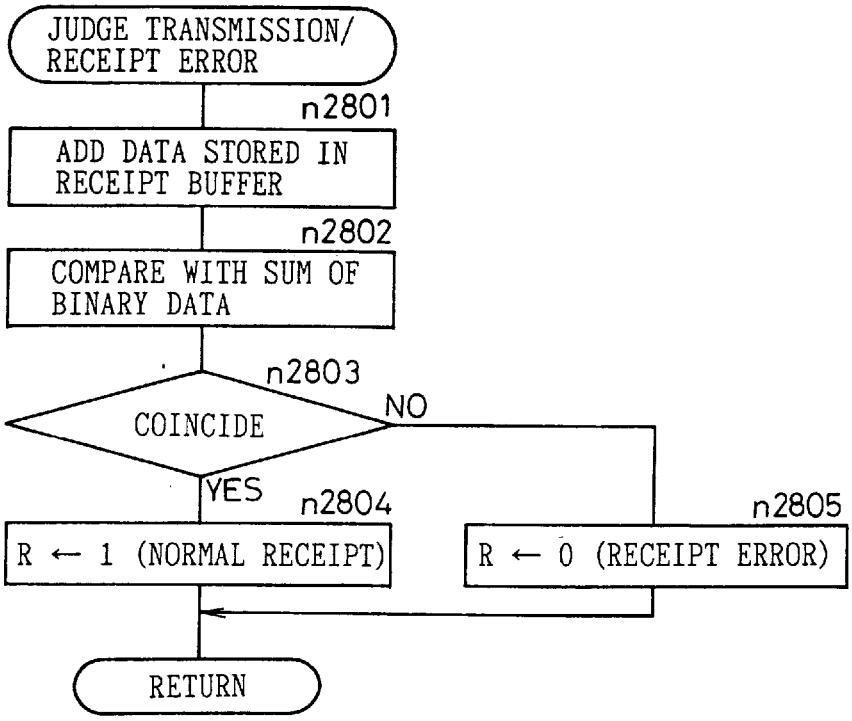
FIG. 29 is a flow chart showing a sequence of processing of the portable terminal apparatus of the embodiment of the invention.
Figure 30:
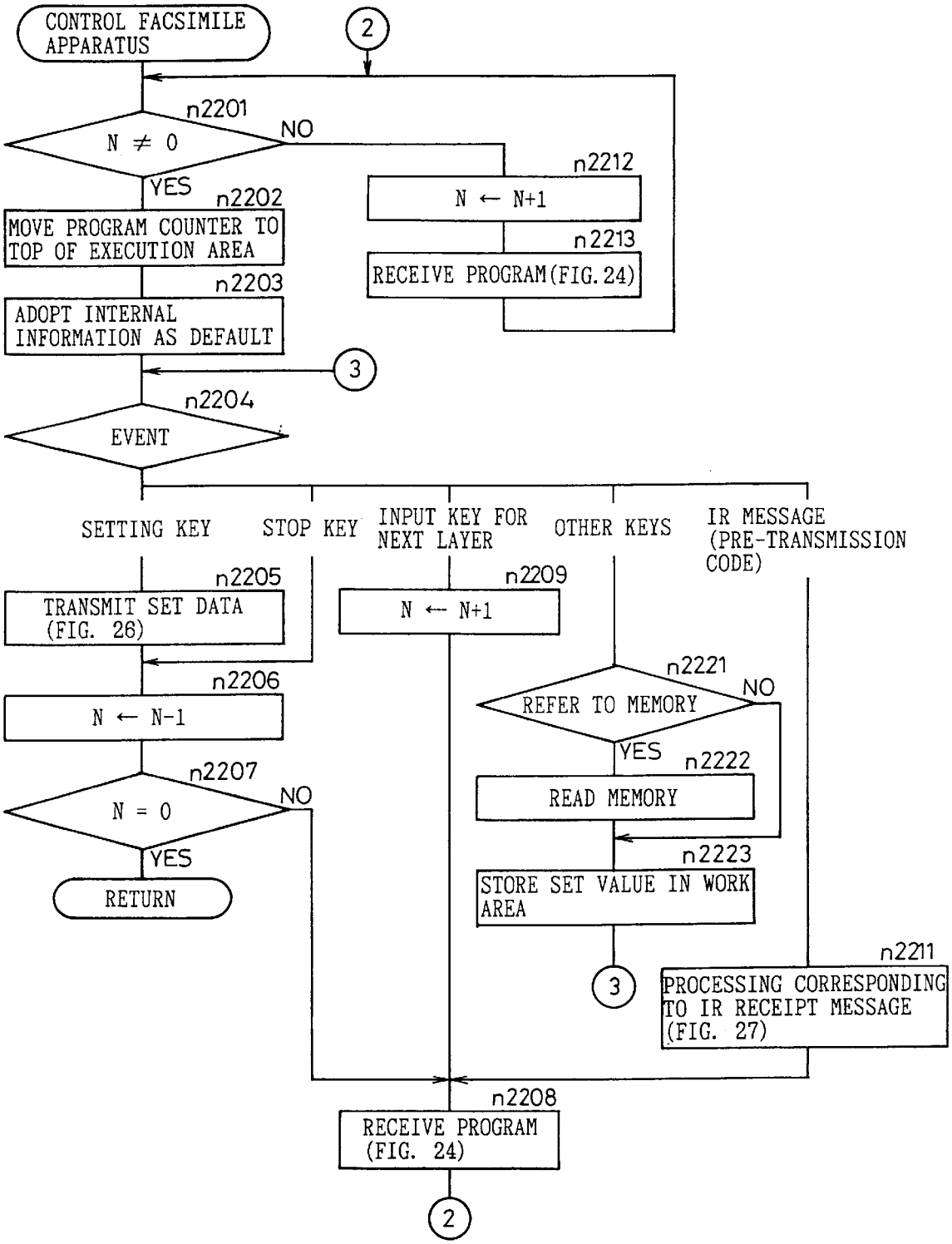
FIG. 30 is a flow chart showing a sequence of processing of a potable terminal apparatus of another embodiment of the invention.

FIG. 30 is a flow chart showing a sequence of processing performed by the portable terminal apparatus 8. In the flow chart in FIG. 30, the same process steps as those shown in FIG. 22 are indicated by the same numbers, and a redundant description will be omitted. Different processing will be described, instead. When an input received while waiting for an event is an operation which instructs to read a telephone number or manipulation of ten numerical keys 100 for inputting the number of copies, whether it is necessary to refer to the RAM 83 is judged (n2221). If it is necessary to refer to the RAM 83, the facsimile apparatus reads designated data from the RAM 83 in response to manipulation of the keys, stores set values and data in the work area of the RAM 83, returns to n2204 to wait for another event. If it is not necessary to refer to the RAM 83, the facsimile apparatus stores a value which is set by means of manipulation of the keys in the work area of the RAM 83, and returns to n2204 to wait for another event.

The facsimile apparatus in this embodiment creates effects which are similar to those created by the copying machine 1 described above. Further, it is possible to avoid labor of reading a telephone number of the like, i.e., private information for a user which is stored in the RAM 83 and transmitting the private information to the facsimile apparatus to input data such as a telephone number to the facsimile apparatus.

Even when the copying machine 1 described in the embodiment described above is to be controlled, data stored in the RAM 63 of the portable terminal apparatus 8 may be read and printed out.

While a sophisticated processing apparatus requires complex setting to execute an advanced function, according to the respective embodiments of the invention, such a sophisticated processing apparatus can be set using a portable terminal apparatus which includes a graphical user interface, as described above. Thus, it is possible to easily execute even complex setting.

A further embodiment of the invention is related to a structure in which it is possible to communicate with the portable terminal apparatus 8 while a processing apparatus such as the copying machine 1 is still performing copying, for example. Hence, a control program can be transmitted to the portable terminal apparatus 8 during copying or the like. Even when other user is using the copying machine 1, for instance, setting is executed in advance on the portable terminal apparatus 8.

If the copying machine 1 does not have such a function as described above, it is necessary to input a setting condition and the like regarding processing to be executed, after the other user finishes using the apparatus. However, the copying machine 1 according to the embodiments can transmit a control program to the portable terminal apparatus 8 even during other processing, and setting for performing processing desired by a user can be executed on the portable terminal apparatus 8. Hence, it is possible to reduce a time which is necessary until the copying machine 1 starts processing when the user actually executes copying or the like after the other user finishes using the apparatus. Further, since setting on the portable terminal apparatus 8 is executed during a time waiting for the other use to finish using the apparatus, time is efficiently used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A control system comprising:

a processing apparatus which creates a control command on the basis of a control program previously stored in the processing apparatus and which executes processing in accordance with the control command;

a terminal apparatus which creates a control command on the basis of the control program stored in the apparatus;

communication means for connecting the processing apparatus to the terminal apparatus using electromagnetic radiation so that data is transmitted and received;

transmission means for transmitting the control program previously stored in the processing apparatus to the terminal apparatus through the communication means;

transmission means for transmitting the control command created on the basis of the control program to the processing apparatus;

transmission means for transmitting internal information within the processing apparatus, to the terminal apparatus through the communication means, the internal information indicating the state of the processing apparatus at the time of responding to the control command; and means for processing on the basis of the internal information transmitted to the terminal apparatus from the processing apparatus.

2. The control system of claim 1, wherein the control system comprises:

detection means for detecting a change in the internal information; and transmission means for transmitting post-change internal information to the terminal apparatus every time there is a change in the internal information.

3. A control system comprising:

a processing apparatus which creates a control command on the basis of a control program previously stored in the processing apparatus and which executes processing in accordance with the control command;

a terminal apparatus which creates a control command on the basis of the control program stored in the apparatus;

communication means for connecting the processing apparatus to the terminal apparatus using electromagnetic radiation so that data is transmitted and received;

transmission means for transmitting the control program previously stored in the processing apparatus to the terminal apparatus through the communication means;

transmission means for transmitting the control command created on the basis of the control program to the processing apparatus;

wherein the control program is composed of a plurality of hierarchical layers; and transmission means for transmitting the control program layer by layer to the terminal apparatus.

4. A control system comprising:

a processing apparatus which creates a control command on the basis of a control program previously stored in the processing apparatus and which executes processing in accordance with the control command;

a terminal apparatus which creates a control command on the basis of the control program stored in the apparatus;

communication means for connecting the processing apparatus to the terminal apparatus using electromagnetic radiation so that data is transmitted and received;

transmission means for transmitting the control program previously stored in the processing apparatus to the terminal apparatus through the communication means;

transmission means for transmitting the control command created on the basis of the control program to the processing apparatus;

storage means for previously storing a control program type depending on a type of the terminal apparatus;

transmission means for transmitting the type of the terminal apparatus connected to the processing apparatus through the communication means, to the processing apparatus; and means for selecting a control program type corresponding to the type of the terminal apparatus transmitted from the terminal apparatus and transmitting the control program of the type to the terminal apparatus.

5. A control system for a processing apparatus comprising:

a processing apparatus which creates a control command on the basis of a control program previously stored in the processing apparatus and which executes processing in accordance with the control command;

a terminal apparatus which creates a control command on the basis of the control program stored in the apparatus;

communication means for connecting the processing apparatus to the terminal apparatus using electromagnetic radiation so that data is transmitted and received;

transmission means for transmitting the control program previously stored in the processing apparatus to the terminal apparatus through the communication means;

transmission means for transmitting the control command created on the basis of the control program to the processing apparatus;

transmission means for transmitting internal information within the processing apparatus to the terminal apparatus through the communication means, the internal information indicating the state of the processing apparatus at the time of responding to the control command;

means for processing on the basis of the internal information transmitted to the terminal apparatus from the processing apparatus;

wherein the control program is composed of a plurality of hierarchical layers; and transmission means for transmitting the control program layer by layer to the terminal apparatus.

* * * * *